US008839492B2

(12) United States Patent
Mizutori et al.

(10) Patent No.: US 8,839,492 B2
(45) Date of Patent: Sep. 23, 2014

(54) APPARATUS FOR PRESSURE STEAM TREATMENT OF CARBON FIBER PRECURSOR ACRYL FIBER BUNDLE AND METHOD FOR PRODUCING ACRYL FIBER BUNDLE

(75) Inventors: Yukihiro Mizutori, Hiroshima (JP); Atsushi Kawamura, Hiroshima (JP); Hiromasa Inada, Hiroshima (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 0 days.

(21) Appl. No.: 13/984,743

(22) PCT Filed: Jan. 17, 2012

(86) PCT No.: PCT/JP2012/050777

§ 371 (c)(1),
(2), (4) Date: Aug. 9, 2013

(87) PCT Pub. No.: WO2012/108230

PCT Pub. Date: Aug. 16, 2012

(65) Prior Publication Data

US 2014/0123713 A1 May 8, 2014

(30) Foreign Application Priority Data

Feb. 10, 2011 (JP) ..... 2011-026960
Jul. 29, 2011 (JP) ..... 2011-167343

(51) Int. Cl.
*D06B 23/16* (2006.01)

(Continued)

(52) U.S. Cl.
CPC *D06B 23/16* (2013.01); *D01F 6/18* (2013.01); *D02J 13/00* (2013.01); *D06M 11/05* (2013.01);

(Continued)

(58) Field of Classification Search
CPC ..... D02J 13/00; D02J 13/001; D06B 3/045; D06B 23/16; D06B 23/18
USPC ..... 19/66 R; 57/308; 68/5 E, 222; 427/434.6
See application file for complete search history.

(56) References Cited

U.S. PATENT DOCUMENTS 3,927,540 A * 12/1975 Tanaka et al. ..... 68/5 E
5,931,972 A * 8/1999 Foster et al. ..... 8/151.2

(Continued)

FOREIGN PATENT DOCUMENTS

| | | |
|---|---|---|
| JP | 48 8661 | 3/1973 |
| JP | 2001 140161 | 5/2001 |
| JP | 2009 256820 | 11/2009 |

OTHER PUBLICATIONS

U.S. Appl. No. 14/004,012, filed Sep. 9, 2013, Mizutori, et al.

(Continued)

*Primary Examiner* — Shaun R Hurley
(74) *Attorney, Agent, or Firm* — Oblon, Spivak, McClelland, Maier & Neustadt, L.L.P.

(57) ABSTRACT

A pressure steam treatment apparatus according to the invention includes a pressure steam treatment chamber and labyrinth sealing chambers. The labyrinth sealing chambers are respectively arranged on a fiber bundle inlet and on a fiber bundle outlet of the steam treatment apparatus, having a running path of the fiber bundle in a horizontal direction and having plural labyrinth nozzles on top and bottom of the running path. The difference between a maximum value and a minimum value of the distance in the perpendicular direction of the top and bottom side labyrinth nozzles, of a pair of opposing labyrinth nozzles is 0.5 mm or smaller when the ambient temperature of the labyrinth sealing chamber is 140° C. This structure ensures that the energy cost can be reduced, the deformation of the apparatus and also, the raise of fuzz on the fiber bundle and fiber bundle breakage can be prevented at the same time.

27 Claims, 21 Drawing Sheets

(51) Int. Cl.

| | |
|---|---|
| ***D01F 6/18*** | (2006.01) |
| ***D02J 13/00*** | (2006.01) |
| ***D06M 11/05*** | (2006.01) |
| ***D02G 3/00*** | (2006.01) |
| ***D06B 3/04*** | (2006.01) |
| ***D06B 23/18*** | (2006.01) |
| ***D02J 1/22*** | (2006.01) |
| *D06M 101/28* | (2006.01) |
| *D01F 9/22* | (2006.01) |

(52) U.S. Cl.

CPC ..... *D06M 2101/28* (2013.01); *D02G 3/00* (2013.01); *D06B 3/045* (2013.01); *D06B 23/18* (2013.01); *D02J 13/001* (2013.01); *D01F 9/22* (2013.01); *D02J 1/222* (2013.01); *D06B 3/04* (2013.01)

USPC ..... 19/66 R

(56) References Cited

U.S. PATENT DOCUMENTS

| | | | | |
|---|---|---|---|---|
| 6,139,588 | A * | 10/2000 | Foster et al. | 8/151.2 |
| 6,652,654 | B1 * | 11/2003 | Propp et al. | 118/718 |
| 6,962,731 | B2 * | 11/2005 | Propp et al. | 427/430.1 |
| 7,356,984 | B2 * | 4/2008 | Brenk | 57/295 |
| 7,475,573 | B2 * | 1/2009 | Brenk | 68/5 E |
| 2004/0058085 | A1 * | 3/2004 | Propp et al. | 427/430.1 |
| 2005/0081335 | A1 * | 4/2005 | Brenk | 19/150 |
| 2005/0102764 | A1 * | 5/2005 | Brenk | 8/149.3 |
| 2013/0340207 | A1 * | 12/2013 | Mizutori et al. | 19/66 R |

OTHER PUBLICATIONS

International Search Report Issued Mar. 19, 2012 in PCT/JP12/50777 Filed Jan. 17, 2012.

* cited by examiner (a)

FIG. 24A

| | STRUCTURE OF THE APPARATUS | | | | | | | | | | | |
|---|---|---|---|---|---|---|---|---|---|---|---|---|
| | FIG. No. | HEAT CONDUCTIVE MEMBER A44 | | | HEAT CONDUCTIVE MEMBER B46 | | | HEAT CONDUCTIVE MEMBER C48 | | RATIO (A2/A1) OF THE HEAT CONDUCTIVE MEMBER TO THE INTERNAL AREA OF THE FRAME BODY 50 | TOTAL LENGTH X | WIDTH Y |
| | | THICKNESS | NUMBER OF SHEETS | INTERVALS BETWEEN MEMBERS | THICKNESS | NUMBER OF SHEETS | INTERVALS BETWEEN MEMBERS | THICKNESS | NUMBER OF SHEETS | | | |
| | | [mm] | [SHEET] | [mm] | [mm] | [SHEET] | [mm] | [mm] | [SHEET] | [%] | [mm] | [mm] |
| EXAMPLE 1 | FIG. 1 | 21 | 2 | 350 | 12 | 12 | 300 | 0 | 0 | 7.5 | 4000 | 1050 |
| EXAMPLE 2 | FIG. 1 | 10 | 2 | 350 | 5 | 12 | 300 | 0 | 0 | 3.4 | 4000 | 1050 |
| EXAMPLE 3 | FIG. 1 | 15 | 2 | 350 | 9 | 12 | 300 | 0 | 0 | 5.5 | 4000 | 1050 |
| EXAMPLE 4 | FIG. 1 | 20 | 10 | 350 | 20 | 26 | 300 | 0 | 0 | 33 | 4000 | 1050 |
| EXAMPLE 5 | FIG. 1 | 30 | 10 | 350 | 30 | 26 | 300 | 0 | 0 | 50 | 4000 | 1050 |
| EXAMPLE 6 | FIG. 12 | - | - | - | - | - | - | - | - | 100 | 4000 | 1050 |
| EXAMPLE 7 | FIG. 6 | 75 | 1 | 525 | 0 | 0 | 0 | 0 | 0 | 7.5 | 4000 | 1050 |
| EXAMPLE 8 | FIG. 8 | 0 | 0 | 0 | 150 | 2 | 1333 | 0 | 0 | 7.5 | 4000 | 1050 |
| EXAMPLE 9 | FIG. 7 | 37.5 | 2 | 350 | 0 | 0 | 0 | 0 | 0 | 7.5 | 4000 | 1050 |
| EXAMPLE 10 | FIG. 9 | 0 | 0 | 0 | 20 | 15 | 250 | 0 | 0 | 7.5 | 4000 | 1050 |
| EXAMPLE 11 | FIG. 10 | 0 | 0 | 0 | 0 | 0 | 0 | 31 | 2 | 7.5 | 4000 | 1050 |
| EXAMPLE 12 | FIG. 11 | 19 | 1 | 525 | 19 | 2 | 1333 | 19 | 2 | 7.5 | 4000 | 1050 |
| EXAMPLE 13 | FIG. 1 | 20 | 2 | 350 | 10 | 8 | 217 | 0 | 0 | 8 | 2000 | 1050 |
| EXAMPLE 14 | FIG. 13 | 0 | 0 | 0 | 0 | 0 | 0 | 0 | 0 | 0 | 4000 | 2050 |
| COMPARATIVE EXAMPLE 1 | FIG. 13 | 0 | 0 | 0 | 0 | 0 | 0 | 0 | 0 | 0 | 4000 | 1050 |
| COMPARATIVE EXAMPLE 2 | FIG. 2 | 20 | 10 | 205 | 10 | 12 | 300 | 0 | 0 | 13 | 4000 | 2050 |

FIG. 24B

| | MAXIMUM TEMPERATURE DIFFERENCE $\Delta T_M$ | LABYRINTH SEAL SECTION | | | | PRESSURE ROOM | | | ΔH (mm) | RATING |
|---|---|---|---|---|---|---|---|---|---|---|
| | | TOTAL LENGTH | OPENING SECTION | | NUMBER OF STAGES OF NOZZLES | PRESSURE | TEMPERATURE | TOTAL LENGTH | | |
| | | | WIDTH W | AVERAGE HEIGHT H | | | | | | |
| | [°C] | [mm] | [mm] | [mm] | | [kPa] | [°C] | [mm] | | |
| EXAMPLE 1 | 18 | 1500 | 1000 | 2 | 60 | 300 | 142 | 1000 | 0.212 | ◎ |
| EXAMPLE 2 | 25 | 1500 | 1000 | 2 | 60 | 300 | 142 | 1000 | 0.478 | ○ |
| EXAMPLE 3 | 22 | 1500 | 1000 | 2 | 60 | 300 | 142 | 1000 | 0.226 | ◎ |
| EXAMPLE 4 | 15 | 1500 | 1000 | 2 | 60 | 300 | 142 | 1000 | 0.127 | ◎ |
| EXAMPLE 5 | 12 | 1500 | 1000 | 2 | 60 | 300 | 142 | 1000 | 0.04 | ◎ |
| EXAMPLE 6 | 8 | 1500 | 1000 | 2 | 60 | 300 | 142 | 1000 | 0.016 | ◎ |
| EXAMPLE 7 | 20 | 1500 | 1000 | 2 | 60 | 300 | 142 | 1000 | 0.285 | ○ |
| EXAMPLE 8 | 24 | 1500 | 1000 | 2 | 60 | 300 | 142 | 1000 | 0.368 | ○ |
| EXAMPLE 9 | 22 | 1500 | 1000 | 2 | 60 | 300 | 142 | 1000 | 0.280 | ○ |
| EXAMPLE 10 | 20 | 1500 | 1000 | 2 | 60 | 300 | 142 | 1000 | 0.243 | ○ |
| EXAMPLE 11 | 21 | 1500 | 1000 | 2 | 60 | 300 | 142 | 1000 | 0.215 | ◎ |
| EXAMPLE 12 | 14 | 1500 | 1000 | 2 | 60 | 300 | 142 | 1000 | 0.190 | ◎ |
| EXAMPLE 13 | 21 | 750 | 1000 | 2 | 30 | 300 | 142 | 500 | 0.336 | ○ |
| EXAMPLE 14 | 38 | 1500 | 1000 | 2 | 60 | 300 | 142 | 1000 | 0.385 | ○ |
| COMPARATIVE EXAMPLE 1 | 38 | 1500 | 1000 | 2 | 60 | 300 | 142 | 1000 | 0.636 | × |
| COMPARATIVE EXAMPLE 2 | 23 | 1500 | 2000 | 2 | 60 | 300 | 142 | 1000 | 0.612 | △ |

FIG. 25A

| | STRUCTURE OF THE APPARATUS | | | | | | | | | | | |
|---|---|---|---|---|---|---|---|---|---|---|---|---|
| | FIG. No. | PRISMATIC MEMBER 44 | | | PRISMATIC MEMBER 46 | | | PRISMATIC MEMBER 48 | | RATIO (A2/A1) OF THE HEAT CONDUCTIVE MEMBER TO THE INTERNAL AREA OF THE FRAME BODY | TOTAL LENGTH X | WIDTH Y |
| | | THICKNESS | NUMBER OF SHEETS | INTERVALS BETWEEN MEMBERS | THICKNESS | NUMBER OF SHEETS | INTERVALS BETWEEN MEMBERS | THICKNESS | NUMBER OF SHEETS | | | |
| | | [mm] | [SHEET] | [mm] | [mm] | [SHEET] | [mm] | [mm] | [SHEET] | | [mm] | [mm] |
| EXAMPLE 15 | FIG. 14 | 75 | 1 | 525 | — | — | — | — | — | 7.5 | 4000 | 1050 |
| EXAMPLE 21 | FIG. 17 | 75 | 1 | 525 | — | — | — | — | — | 7.5 | 4000 | 1050 |
| COMPARATIVE EXAMPLE 3 | — | 75 | 1 | 525 | — | — | — | — | — | 7.5 | 4000 | 1050 |
| | | | | | | | | | | | | |
| EXAMPLE 16 | FIG. 14 | 37.5 | 2 | 350 | — | — | — | — | — | 7.5 | 4000 | 1050 |
| EXAMPLE 22 | FIG. 17 | 37.5 | 2 | 350 | — | — | — | — | — | 7.5 | 4000 | 1050 |
| COMPARATIVE EXAMPLE 4 | — | 37.5 | 2 | 350 | — | — | — | — | — | 7.5 | 4000 | 1050 |
| | | | | | | | | | | | | |
| EXAMPLE 17 | FIG. 18 | — | — | — | 20 | 15 | 250 | — | — | 7.5 | 4000 | 1050 |
| EXAMPLE 23 | FIG. 19 | — | — | — | 20 | 15 | 250 | — | — | 7.5 | 4000 | 1050 |
| COMPARATIVE EXAMPLE 5 | — | — | — | — | 20 | 15 | 250 | — | — | 7.5 | 4000 | 1050 |

FIG. 25B

| | TEMPERATURE OF THE LID PLATE | | LABYRINTH SEAL SECTION | | PRESSURE ROOM | UNEVENNESS OF THE HEIGHT OF THE OPENING SECTION AFTER PRESSURE STEAM TREATMENT | RESULT |
|---|---|---|---|---|---|---|---|
| | UPPER SIDE LID PLATE 40A | LOWER SIDE LID PLATE 40B | TOTAL LENGTH | OPENING SECTION WIDTH W | TEMPERATURE | UNEVENNESS (MAXIMUM) OF THE HEIGHT OF THE OPENING SECTION 26 IN THE DIRECTION OF THE WIDTH/WIDTH W $\times 10^{-3}$ OF THE OPENING SECTION | FREQUENCY OF THE RAISE OF FUZZ ON THE THREAD |
| | [°C] | [°C] | [mm] | [mm] | [°C] | | |
| EXAMPLE 15 | 142 | 142 | 1500 | 1000 | 142 | 0.064 | ◎ |
| EXAMPLE 21 | 158 | LEAVING UNMEASURED | 1500 | 1000 | 142 | 0.152 | ○ |
| COMPARATIVE EXAMPLE 3 | LEAVING UNMEASURED | LEAVING UNMEASURED | 1500 | 1000 | 142 | 0.285 | △ |
| | | | | | | | |
| EXAMPLE 16 | 142 | 142 | 1500 | 1000 | 142 | 0.18 | ○ |
| EXAMPLE 22 | 158 | LEAVING UNMEASURED | 1500 | 1000 | 142 | 0.152 | ○ |
| COMPARATIVE EXAMPLE 4 | LEAVING UNMEASURED | LEAVING UNMEASURED | 1500 | 1000 | 142 | 0.280 | △ |
| | | | | | | | |
| EXAMPLE 17 | 142 | 142 | 1500 | 1000 | 142 | 0.057 | ◎ |
| EXAMPLE 23 | 158 | LEAVING UNMEASURED | 1500 | 1000 | 142 | 0.097 | ◎ |
| COMPARATIVE EXAMPLE 5 | LEAVING UNMEASURED | LEAVING UNMEASURED | 1500 | 1000 | 142 | 0.243 | △ |

FIG. 25C

| | STRUCTURE OF THE APPARATUS | | | | | | | | | | | |
|---|---|---|---|---|---|---|---|---|---|---|---|---|
| | FIG. No. | PRISMATIC MEMBER 44 | | | PRISMATIC MEMBER 46 | | | PRISMATIC MEMBER 48 | | RATIO (A2/A1) OF THE HEAT CONDUCTIVE MEMBER TO THE INTERNAL AREA OF THE FRAME BODY | TOTAL LENGTH X | WIDTH Y |
| | | THICKNESS | NUMBER OF SHEETS | INTERVALS BETWEEN MEMBERS | THICKNESS | NUMBER OF SHEETS | INTERVALS BETWEEN MEMBERS | THICKNESS | NUMBER OF SHEETS | | | |
| | | [mm] | [SHEET] | [mm] | [mm] | [SHEET] | [mm] | [mm] | [SHEET] | | [mm] | [mm] |
| EXAMPLE 18 | FIG. 20 | — | — | — | — | — | — | 31 | 2 | 7.5 | 4000 | 1050 |
| EXAMPLE 24 | FIG. 21 | — | — | — | — | — | — | 31 | 2 | 7.5 | 4000 | 1050 |
| COMPARATIVE EXAMPLE 6 | — | — | — | — | — | — | — | 31 | 2 | 7.5 | 4000 | 1050 |
| | | | | | | | | | | | | |
| EXAMPLE 19 | FIG. 14 | 21 | 2 | 350 | 12 | 12 | 300 | — | — | 7.5 | 4000 | 1050 |
| EXAMPLE 25 | FIG. 15 | 21 | 2 | 350 | 12 | 12 | 300 | — | — | 7.5 | 4000 | 1050 |
| COMPARATIVE EXAMPLE 7 | — | 21 | 2 | 350 | 12 | 12 | 300 | — | — | 7.5 | 4000 | 1050 |
| | | | | | | | | | | | | |
| EXAMPLE 20 | FIG. 22 | 19 | 1 | 525 | 19 | 2 | 1333 | 19 | 2 | 7.5 | 4000 | 1050 |
| EXAMPLE 26 | FIG. 23 | 19 | 1 | 525 | 19 | 2 | 1333 | 19 | 2 | 7.5 | 4000 | 1050 |
| COMPARATIVE EXAMPLE 8 | — | 19 | 1 | 525 | 19 | 2 | 1333 | 19 | 2 | 7.5 | 4000 | 1050 |

FIG. 25D

| | TEMPERATURE OF THE LID PLATE | | LABYRINTH SEAL SECTION | | PRESSURE ROOM | UNEVENNESS OF THE HEIGHT OF THE OPENING SECTION AFTER PRESSURE STEAM TREATMENT | RESULT |
|---|---|---|---|---|---|---|---|
| | UPPER SIDE LID PLATE 40A | LOWER SIDE LID PLATE 40B | TOTAL LENGTH | OPENING SECTION WIDTH W | TEMPERATURE | UNEVENNESS (MAXIMUM) OF THE HEIGHT OF THE OPENING SECTION 26 IN THE DIRECTION OF THE WIDTH/WIDTH W $\times 10^{-3}$ OF THE OPENING SECTION | FREQUENCY OF THE RAISE OF FUZZ ON THE THREAD |
| | [°C] | [°C] | [mm] | [mm] | [°C] | | |
| EXAMPLE 18 | 142 | 142 | 1500 | 1000 | 142 | 0.120 | ○ |
| EXAMPLE 24 | 158 | LEAVING UNMEASURED | 1500 | 1000 | 142 | 0.079 | ◎ |
| COMPARATIVE EXAMPLE 6 | LEAVING UNMEASURED | LEAVING UNMEASURED | 1500 | 1000 | 142 | 0.215 | △ |
| | | | | | | | |
| EXAMPLE 19 | 142 | 142 | 1500 | 1000 | 142 | 0.055 | ◎ |
| EXAMPLE 25 | 158 | LEAVING UNMEASURED | 1500 | 1000 | 142 | 0.082 | ◎ |
| COMPARATIVE EXAMPLE 7 | LEAVING UNMEASURED | LEAVING UNMEASURED | 1500 | 1000 | 142 | 0.212 | △ |
| | | | | | | | |
| EXAMPLE 20 | 142 | 142 | 1500 | 1000 | 142 | 0.112 | ○ |
| EXAMPLE 26 | 142 | LEAVING UNMEASURED | 1500 | 1000 | 142 | 0.103 | ○ |
| COMPARATIVE EXAMPLE 8 | LEAVING UNMEASURED | LEAVING UNMEASURED | 1500 | 1000 | 142 | 0.190 | △ |

APPARATUS FOR PRESSURE STEAM TREATMENT OF CARBON FIBER PRECURSOR ACRYL FIBER BUNDLE AND METHOD FOR PRODUCING ACRYL FIBER BUNDLE

CROSS REFERENCE TO RELATED APPLICATIONS

The present application is a 35 U.S.C. §371 national stage patent application of International patent application PCT/JP2012/050777, filed on Jan. 17, 2012, published as WO/2012/108230 on Aug. 16, 2012, the text of which is incorporated by reference, and claims the benefit of the filing date of Japanese application nos. 2011-026960, filed on Feb. 10, 2011, and 2011-167343, filed on Jul. 29, 2011, the text of both of which is also incorporated by reference.

TECHNICAL FIELD

The invention relates to a pressure steam treatment apparatus preferably applied when fibers are drawn, specifically, to a pressure steam treatment apparatus in which fiber bundles are drawn under a pressure steam atmosphere, and particularly, to a pressure steam treatment apparatus capable of continuously treating a plurality of fiber bundles collectively in pressure steam treatment of a plurality of fiber bundles under a pressure steam atmosphere and to a method for producing acryl fiber bundles.

BACKGROUND ART

In the production of carbon fibers and such, fiber bundles made of a polyacrylonitrile type polymer and such are used as raw threads. These fiber bundles need to have excellent strength and high degree of orientation. Such a fiber bundle, for example may be obtained by spinning a yarn raw solution containing a polyacrylonitrile polymer to form, a solidified fiber, which is then drawn in a bath, followed by drying to densify, thereby obtaining a fiber bundle, which is then subjected to a secondary drawing process carried out under a pressure steam atmosphere.

For the treatment of the fiber bundle under a pressure steam environment, a treatment apparatus is used which makes fiber bundles run inside thereof and supplies pressure steam to the fiber bundle. In such a treatment apparatus, there was the case where the pressure, temperature and humidity in the apparatus became unstable, causing the raise of fuzz on the fiber bundle and fiber bundle breakage, if the pressure steam supplied to the inside of the apparatus leaked in a large amount externally from the inlet and outlet of the pressure steam treatment apparatus. Also, a large amount of pressure steam is required to suppress the influence of the leakage of steam from the apparatus, leading to increase in energy cost.

As a treating apparatus that restrains the leakage of pressure steam from the inside of the apparatus, a pressure steam treating apparatus is known which is provided with a pressure steam treating section for treating fiber bundles running in a fixed direction and two labyrinth sealing chambers extending from the front and back of the pressure steam treating section. The above labyrinth sealing chambers were each provided with a plurality of labyrinth nozzles made of plate fragments extending at right angle from the internal wall surface thereof to the fiber bundles wherein steam energy is consumed when steam passes through each space (expansion room) between these labyrinth nozzles, to thereby reduce the leak amount of pressure steam.

Specifically, Japanese Patent Application Laid-Open No. 2001-140161 (Patent Document 1) discloses a pressure steam treatment apparatus which is provided with a pressure steam treating section and two labyrinth sealing chambers extending from the front and back of the pressure steam treating section, wherein each labyrinth sealing chamber is provided with labyrinth nozzles in 80 to 120 stages, and the ratio (L/P) of the length L of the labyrinth nozzle extended from the inside wall to the pitch P between adjacent labyrinth nozzles is from 0.3 to 1.2.

CITATION LIST

Patent Document

Patent Document 1: Japanese Patent Application Laid-Open No. 2001-140161

SUMMARY OF THE INVENTION

Problems to be Solved by the Invention

However, in the pressure steam treating apparatus of Patent Document 1, no attention is paid at all to the influence of heat and pressure on the pressure steam treatment apparatus itself and no study has been even made on the influence. According to this type of pressure steam treatment apparatus, the occurrences of fuzz on the fiber bundle and fiber bundle breakage tend to increase by long-time continuous treatment. When examining the reasons, one of the reasons is the deformation of the pressure steam treatment apparatus because of continuous operation of the pressure steam treatment apparatus. The deformation is typified by the pressure deformation of the apparatus due to the pressure of the pressure steam and thermal deformation due to a rise of the temperature of the members of the apparatus caused by high temperature of the pressure steam.

With regard to the pressure deformation of the apparatus, the body constituting the pressure steam treatment chamber and labyrinth sealing chamber is fixedly installed in such a manner that it is covered with an external wall member constituted of rectangular-shaped members arranged lengthwise and crosswise along the upper and lower surfaces of the body of the apparatus to thereby provide pressure resistance to the apparatus. However, when only the frame structure is adopted, the body constituting the pressure steam section and labyrinth sealing chamber is heated and expanded, whereas a beam member of the prismatic member and external wall member are cooled because of the temperature difference between these members and the peripheral atmosphere and therefore reduced in thermal expansion as compared with the body constituting these pressure steam treatment chamber and labyrinth sealing chamber. Accordingly, the difference in thermal expansion between the body constituting these pressure steam treatment and labyrinth sealing chamber and the prismatic member and external wall member causes a warpage of the whole apparatus.

In multi-spindle batch process in which a plurality of fiber bundles are made to run, the leakage of steam from the fiber bundle inlet and outlet is restrained to stabilize the treatment by limiting the number of labyrinth nozzles to be installed and intervals between the nozzles like the invention disclosed in the above Patent Document 1. However, the interference between adjacent fiber bundles running together cannot be reduced. Though it is considered to be better to widen the width of the opening section of running fiber bundles to avoid this interference, the warpage of the pressure steam treatment apparatus due to thermal deformation is increased if the width is widened, and therefore, such a phenomenon is observed that the height of the opening section at the center of the section of the opening section largely differs from that at each end of the opening section. As a result, the opening height required for the passing of fiber bundles cannot be secured in a part of the opening height, and there is therefore the case where the fiber bundles are brought into contact with the labyrinth nozzle, causing the raise of fuzz on the fiber bundle and fiber bundle breakage.

Also, if it is intended to increase the width of the opening section in the pressure steam treatment apparatus described in the above Patent Document 1, it is inevitable to increase the height of the opening section to a level higher than a desired opening height to secure the opening height necessary to pass the fiber bundles, resulting in increase in the amount of pressure steam leaked from the pressure steam treatment apparatus, giving rise to the problem concerning increased cost on the contrary.

The invention has been made to solve the aforementioned problems at the same time and it is an object of the invention to provide a pressure steam treatment apparatus provided with a pressure steam treatment chamber, and two labyrinth sealing chambers extending from the front and back of the pressure steam treatment chamber, the apparatus treating a plurality of fiber bundles running side by side sheet-wise along the running path collectively in a pressure steam atmosphere, and ensuring that the energy cost necessary due to the leakage of pressure steam can be reduced, thermal deformation of the apparatus can be prevented, and also, the raise of fuzz on the fiber bundle and fiber bundle breakage can be prevented.

Another object of the invention is to provide a pressure steam treatment apparatus provided with a pressure steam treatment chamber, and two labyrinth sealing chambers extending from the front and back of the pressure steam treatment chamber, the apparatus treating a plurality of fiber bundles running side by side sheet-wise along the running path collectively in a pressure steam atmosphere, and ensuring that the energy cost necessary due to the leakage of pressure steam can be reduced, and also, the raise of fuzz on the fiber bundle and fiber bundle breakage can be prevented without fail.

Means for Solving the Problems

A pressure steam treatment apparatus for a carbon fiber precursor acryl fiber bundle of the present invention includes a pressure steam treatment chamber and a first and a second labyrinth sealing chamber arranged adjacent to the front and back of a pressure steam treatment chamber in the running direction of fiber bundles, the apparatus being characterized in that the labyrinth sealing chambers are respectively arranged on a fiber bundle inlet and on a fiber bundle outlet of the steam treatment apparatus, having a running path of the fiber bundle in a horizontal direction and having plural labyrinth nozzles on top and bottom of the running path, and the labyrinth nozzles are comprised by having top side labyrinth nozzle and bottom side labyrinth nozzle located by opposing each other, the difference ($\Delta H$) between a maximum value and a minimum value of the distance in the perpendicular direction of the top and bottom side labyrinth nozzles, of a pair of opposing labyrinth nozzles is 0.5 mm or smaller when the ambient temperature of the labyrinth sealing chambers is 140° C.

Here, the apparatus includes an external wall member on an upper surface of the pressure steam treatment apparatus excluding a steam inlet, having a plate member extending toward a top board of the pressure steam treatment apparatus, an external wall member on a lower surface of the pressure steam treatment apparatus excluding a steam inlet, and having a plate member extending toward a bottom board of the pressure steam treatment apparatus, and when the ambient temperature of the pressure steam treatment chamber or labyrinth sealing chamber is 140° C., a difference in temperature between an optional point on the top or bottom boards of the pressure steam treatment chamber and a point on the external wall member opposite to the optional point is 30° C. or less.

The external wall member may be a member having a linear expansion coefficient higher than those of the top board and bottom board.

It is preferable that a heat conductive member be disposed in a space part formed between at least the upper surface of the pressure steam treatment chamber and the labyrinth sealing chamber and the external wall member.

A pressure steam treatment apparatus according to another embodiment of the invention includes a pressure steam treatment chamber and a labyrinth sealing chamber, the apparatus being characterized in that the labyrinth sealing chamber is respectively arranged on a fiber bundle inlet and a fiber bundle outlet of the steam treatment apparatus, having a running path of the fiber bundle in a horizontal direction, and it includes an external wall member on an upper surface of the pressure steam treatment apparatus excluding a steam inlet, having a plate member extending toward a top board of the pressure steam treatment apparatus, an external wall member on an lower surface of the pressure steam treatment apparatus excluding a steam inlet, and having a plate member extending toward a bottom board of the pressure steam treatment apparatus, and a heat conductive member is disposed in a space part between at least the top board of the pressure steam treatment chamber and the external wall member on the upper surface of the top board.

With regard to an optional section having the above space part parallel to the above top board in the space part, the ratio (A2/A1) of the sectional area A2 of the above heat conductive member to the area A1 enclosed by the above plate member is preferably 5% or more.

As the above heat conductive member, a material having a heat conductivity of 16 W/(mK) or more is preferably used. Also, the ratio (H/W) of the height H to width W of the rectangular-shaped opening section formed between the opposing top and bottom labyrinth nozzles in the labyrinth sealing chamber is preferably 1/2000 to 1/60.

As to the above heat conductive member, one or two or more heat conductive members may be arranged at a right angle to the external wall member (40) and also at a right angle to the opening section and/or parallel to the opening section. Also, when two or more of the heat conductive members are arranged, the heat conductive members are preferably arranged at intervals of 100 mm to 500 mm. This structure ensures that the heat given from pressure steam used to treat fiber bundles to the structural members constituting the pressure steam treatment chamber and labyrinth sealing chamber can be efficiently conducted to the external wall member, thereby making possible to reduce the heat deformation of the pressure steam treatment apparatus.

In this description of the invention, a typical example is shown in which the heat conductive members are arranged grid-wise in a space formed between the pressure steam treatment chamber and labyrinth sealing chamber and the external wall member through the plate member. One or a plurality of first heat conductive members may be arranged at a right angle to the pressure steam treatment chamber and labyrinth sealing chamber and in parallel to the direction of running fiber bundles and, at the same time, one or a plurality of second heat conductive members may be arranged at a right angle to the pressure steam treatment chamber and labyrinth sealing chamber and in parallel to a direction in which the row of fiber bundles are arranged. When a plurality of heat conductive members is arranged, they are preferably arranged at intervals of 100 mm to 500 mm. This structure ensures that the heat given from pressure steam used to treat fiber bundles to the members constituting the pressure steam treatment chamber and labyrinth sealing chamber can be efficiently conducted to the external wall member, thereby making possible to reduce the heat deformation of the pressure steam treatment apparatus.

Also, as the heat conductive member, one or a plurality of third heat conductive members may be arranged at a right angle to the external wall member and also diagonally to the direction of opening section. Further, one or two or more heat conductive members may be arranged at a right angle to the external wall member and also at a right angle to the opening section and diagonally to the opening section.

Also, the pressure steam treatment apparatus is preferably provided with a heating device (for example, a heater) for heating the external wall member. It is preferable that the pressure steam treatment apparatus be further provided with a device for detecting the temperature of the external member heated by the heating device and with a temperature control device for controlling the heating temperature of the heating device.

Moreover, a pressure steam treatment apparatus according to another embodiment of the invention includes a pressure steam treatment chamber and a labyrinth sealing chamber, the apparatus being characterized in that the labyrinth sealing chambers are respectively arranged on a fiber bundle inlet and a fiber bundle outlet of the steam treatment apparatus, having a running path of the fiber bundle in a horizontal direction, and it includes an external wall member on an upper surface of the pressure steam treatment apparatus excluding a steam inlet, having a plate member extending toward a top board of the pressure steam treatment apparatus, an external wall member on an lower surface of the pressure steam treatment apparatus excluding a steam inlet, and having a plate member extending toward a bottom board of the pressure steam treatment apparatus, and is provided with a heating device that heats the external wall member. Further, the apparatus is preferably provided with a device that detects the temperature of the external wall member heated by the heating device and a control device that controls the heating temperature of the heating device based on the results of detection of the temperature control device.

According to the invention, there is provided a method for producing an acryl fiber bundle, the method including performing drawing treatment of acryl fiber bundles by a pressure steam treatment apparatus for acryl fiber bundles which has the above structure.

Effects of the Invention

In the pressure steam treatment apparatus of the invention which adopts the above structure, fiber bundles are treated with pressure steam, thereby enabling the prevention of the raise of fuzz on the fiber bundle and fiber bundle breakage, and therefore, high quality fiber bundles can be obtained. Also, the heat given from pressure steam used to treat fiber bundles to the members forming the pressure steam treatment chamber and labyrinth sealing chamber can be efficiently conducted to the external wall member, thereby making possible to reduce the heat deformation of the pressure steam treatment apparatus.

Also, in the pressure steam treatment apparatus according to another embodiment of the invention, an external wall member including a plate member is fixedly installed so as to cover the body of the apparatus to thereby secure the strength of the whole apparatus, and a heating device is provided in the external wall member to thereby eliminate the temperature difference between the body of the apparatus and the external wall member, with the result that pressure deformation and temperature deformation of the whole apparatus can be restrained, the energy cost necessary due to the leakage of pressure steam can be reduced, and also, the raise of fuzz on the fiber bundle and fiber bundle breakage can be prevented at the same time.

BRIEF DESCRIPTION OF THE DRAWINGS

FIG. 24 is an explanatory view that shows various data of structural members of a pressure steam treatment apparatus used in Examples 1 to 14 and Comparative Examples 1 and 2, and a numerical analysis result of a difference ΔH between the height H1 of the section at the center 34 of the opening section and the height H2 of the section at each end 36 of the opening in FIG. 5.

FIG. 25 is an explanatory view that shows an evaluation result based on the number of the raise of fuzz on the fiber bundle of the unevenness of the height of the opening section 26 after pressure steam treatment in Examples 15 and 16 and Comparative Examples 3 to 8.

BEST MODE FOR CARRYING OUT THE INVENTION (Pressure Steam Treatment Apparatus)

Figure 1:
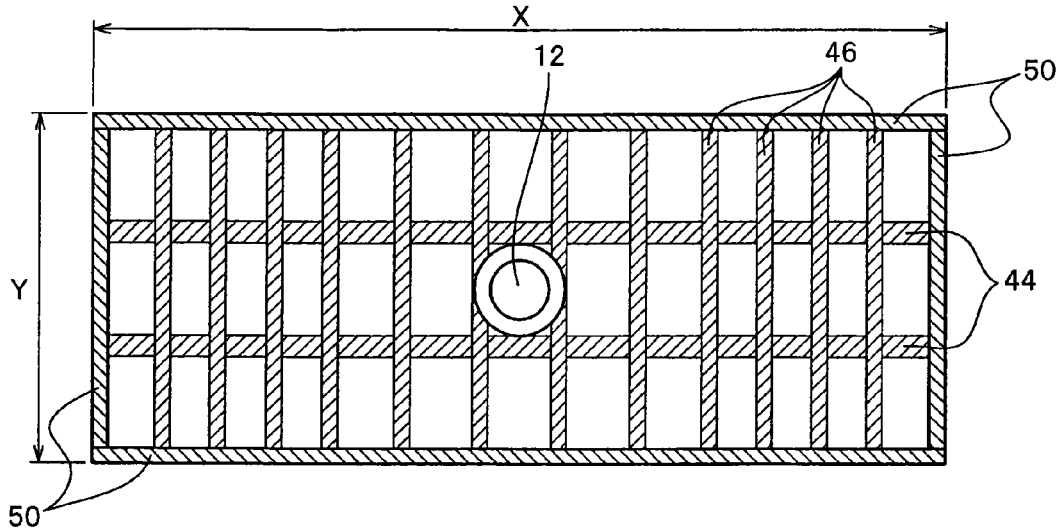
FIG. 1 is a plan and sectional view showing a schematic structure of a pressure steam treatment apparatus of the invention.
Figure 2:
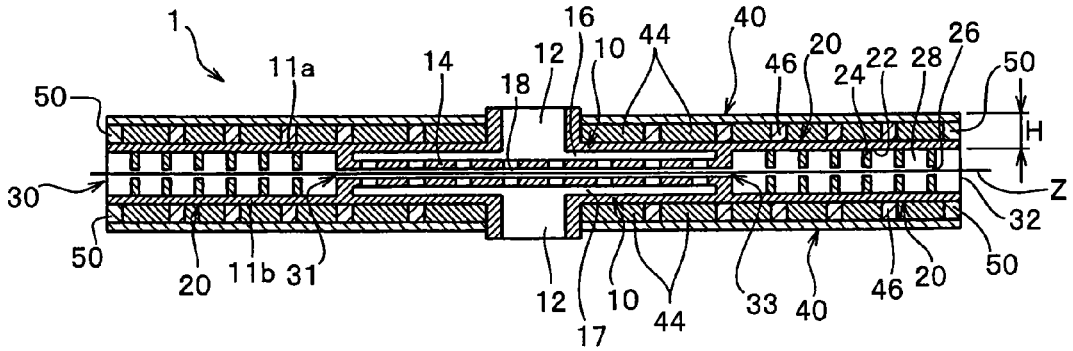
FIG. 2 is a vertical and sectional view showing the arrangement of heat conductive members inside of a plate member of each pressure steam treatment apparatus in Examples 1 to 5 and 13 of the invention.

FIGS. 1 and 2 are a plan and sectional view and a vertical and sectional view showing an example of a first embodiment of a pressure steam treatment apparatus for acryl fiber bundles which are precursors of carbon fibers according to the invention.

A pressure steam treatment apparatus (hereinafter referred to as a treatment apparatus) 1 in this embodiment is provided with a pressure steam treatment chamber 10 for treating acryl fiber bundles (hereinafter referred to simply as fiber bundles) Z which are precursors of carbon fibers running in a fixed direction by pressure steam and with two labyrinth sealing chambers extending to the fiber bundle inlet and fiber bundle outlet (in front and back of the fiber bundle running direction) respectively. There is no substantial difference between the structures of the pressure steam treatment chamber 10 and labyrinth sealing chamber 20 and those of the pressure steam treatment chamber and labyrinth sealing chamber of the pressure steam treatment apparatus disclosed in the above Patent Document 1. For this, specific structures and detailed explanations of the pressure steam treatment chamber 10 and labyrinth sealing chamber 20 are committed to the quotation from the descriptions of the above Patent Document 1 in the following explanations.

According to the illustrated example, the pressure steam treatment chamber 10 and labyrinth sealing chamber 20 are provided with a top board 11*a* and a bottom board 11*b* which are made of upper and lower single plane plates. The pressure steam treatment chamber 10 is located in the center part between the top board 11*a* and bottom board 11*b* and the labyrinth sealing chambers 20 are disposed adjacent to the front and back of the pressure steam treatment chamber 10. The pressure steam treatment chamber 10 disposed in the center part between the top board 11*a* and the bottom board 11*b* is provided with a porous plate 14 made of two porous plate materials which are to be disposed on the upper and lower sides of a fiber bundle running path 18 of the fiber bundles Z sandwiched therebetween. Pressure rooms 16 and 17 are formed between the top and bottom boards 11*a* and 11*b* and each porous plate 14. This pressure room 16 is provided with a pressure steam inlet 12 for supplying steam from the outside on each of the upper and lower side thereof. The pressure steam inlet 12 is formed on each of the upper and lower parts of the center of the pressure steam treatment chamber 10. This pressure steam inlet 12 may be formed on either the upper or lower part.

Any material may be used as the material constituting the pressure steam treatment chamber 10 insofar as it has mechanical strength high enough to stand against the pressure of pressure steam. Examples of the material include stainless steel having corrosion resistance and iron steel materials provided with anticorrosive coat.

The labyrinth sealing chamber 20 is provided with a plurality of labyrinth nozzles 24 made of plate fragments projecting perpendicularly in a direction decreased in the distance between the upper and lower fragments, from each internal wall surface 22 of the top board 11*a* and bottom board 11*b* towards the fiber bundles Z. An opening section 26 which is to be the fiber bundle running path inside of the labyrinth sealing chamber 20 is formed by the labyrinth nozzles 24 and an expansion room 28 is formed between adjacent labyrinth nozzles 24. Also, a fiber bundle inlet 30 for introducing the fiber bundles Z is formed in a first labyrinth sealing chamber 31 on the primary (rear part) side of the pressure steam treatment chamber 10 and a fiber bundle outlet 32 from which the fiber bundles Z are discharged is formed in a second labyrinth sealing chamber 33 on the secondary (front part) side of the pressure steam treatment 10.

Examples of the material of the plate fragment constituting the labyrinth nozzle 24 include, though not particularly limited to, stainless, titanium, titanium alloys, andiron steel material surface-treated by hard chromium plating in the point that these materials each have corrosion resistance and can reduce damages to the fiber bundles when they are in contact with the fiber bundles.

The formation of the expansion room 28 between adjacent labyrinth nozzles 24 in the labyrinth sealing chamber 20 causes the generation of eddy current in the flow of pressure steam in the expansion room 28 to consume energy, thereby dropping the pressure, leading to reduction in the amount of pressure steam leakage.

The labyrinth nozzle 24 is made of a narrow plate fragment and is formed so as to project at right angle with the fiber bundles Z running through the opening section 26 of the labyrinth section 20 from the internal wall surface 22 of the top and bottom boards 11*a* and 11*b*. The labyrinth nozzle 24 is preferably a plate fragment having a rectangular frame form, though no particular limitation is imposed on the shape of the labyrinth nozzle 24.

Figure 3:
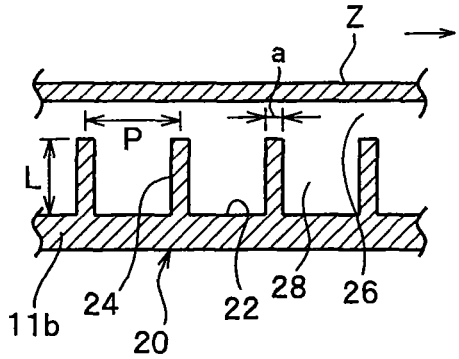
FIG. 3 is a partially enlarged sectional view in a labyrinth nozzle of a pressure steam treatment apparatus shown in FIG. 2.

This labyrinth nozzle 24 may be projected from all of the internal wall surface 22 in all regions of the labyrinth sealing chamber 20 or may be projected from the internal wall surface 22 excluding that of a part of the labyrinth sealing chamber 20. Specifically, as shown in FIG. 3, the labyrinth nozzles 24 may be projected as one unit from each internal wall surface 22 of the top and bottom boards 11*a* and 11*b* towards the fiber bundles Z running in the labyrinth sealing chamber 20 over the entire region of the labyrinth sealing chamber 20. In this case, a pair of upper and lower labyrinth nozzles 24 may be projected from each of the upper and lower internal wall surfaces 22 opposite to each other towards the fiber bundles Z running in the opening section 26 of the labyrinth sealing chamber 20 and a rectangular-shaped opening section 26 may be formed by the pair of labyrinth nozzles 24 and left and right internal wall surfaces 22.

Although the ratio (L/P) of the projected length L (FIG. 3) from each internal wall surface 22 of the top and bottom boards 11*a* and 11*b* to the pitch P (FIG. 3) between adjacent labyrinth nozzles 24 is preferably less than 0.3, there is no particular limitation to the ratio. Also, though the projected length L of the labyrinth nozzle 24 from each internal wall surface 22 of the top and bottom plates 11*a* and 11*b* is preferably 3 mm or more, there is no particular limitation to the length.

The pitch P between adjacent labyrinth nozzles 24 is preferably 16 to 29 mm, though no particular limitation is imposed on the pitch.

Though the thickness a (FIG. 3) of the plate fragment constituting the labyrinth nozzle 24 is preferably 3 mm or less, no particular limitation is imposed on the thickness.

Although the number of stages of the labyrinth nozzle 24 is preferably 20 to 80, no particular limitation is imposed on that number.

Also, the shape of the labyrinth nozzle 24 is not limited to a flat plate form illustrated in FIGS. 1 to 3.

Figure 4:
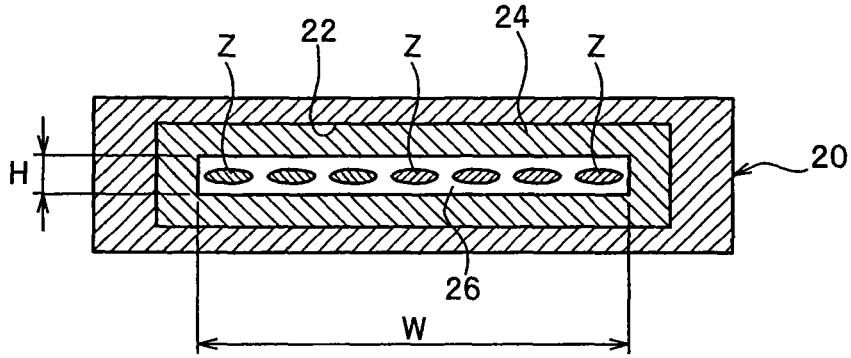
FIG. 4 is a vertical and sectional view showing the state of the structural part of a labyrinth nozzle of a labyrinth sealing chamber shown in FIG. 2 before pressure steam treatment.

The opening section 26 formed by the labyrinth nozzle 24 is preferably made into a rectangular-shaped form extending in a horizontal direction as shown in FIG. 4. If the opening section 26 has a rectangular-shaped form, the fiber bundles Z running in the treatment apparatus 1 is kept in a flat state enabling the fiber bundles Z to easily pass therethrough and pressure steam blown out in the pressure steam treatment chamber 10 easily reach the surface of the fiber bundles Z, and the penetration and contact of pressure steam can be promoted. This makes it easy to heat the fiber bundles Z uniformly by pressure steam in a short time.

Also, the opening section 26 is preferably formed in the center in the direction of the height of the labyrinth sealing chamber 20. This easily prevents the occurrence of such a phenomenon that the flow streams of pressure steam in the upper and bottom regions partitioned by the fiber bundles Z running in the labyrinth sealing chamber 20 of the expansion room 28 differ from each other, which makes unstable the running of the fiber bundles Z.

The ratio (H/W) (FIG. 4) of the height H to width W of the rectangular-shaped opening section 26 of the labyrinth nozzle 24 is preferably 1/2000 to 1/60. When the ratio (H/W) is 1/2000 or more, this reduces the interference between adjacent fiber bundles Z running together in, particularly, a multi-spindle batch process in which a plurality of fiber bundles Z are made to run, and also makes it easy to restrain the damages and entanglement of fibers caused by the interference, thereby making it easy to restrain the raise of fuzz on the fiber bundle and fiber bundle breakage. Also, when the above ratio (H/W) is 1/60 or less, this makes it easy to keep the fiber bundles flat and to reduce the amount of pressure steam leakage at the same time.

The treatment apparatus 1 is preferably so designed that it is divided into two sections, that is, the upper section and lower section with the fiber bundles Z running in the apparatus as its center. This makes it possible to carry out threading work in a short time with ease when, particularly, a plurality of fiber bundles is collectively drawn under a pressure steam atmosphere while the fiber bundles Z are made to run in parallel in the treatment apparatus 1.

When adopting the structure obtained by dividing the treatment apparatus 1 into two sections, there is no particular limitation to an opening/closing mechanism of the divided apparatus bodies, and, for example, a mechanism in which the divided apparatus bodies are linked by a hinge to switch the opening/closing of the both may be adopted. Also, a method may be adopted in which the divided upper apparatus body section is lifted to open/close. In such a case, it is preferable to make a structure in which the joint part between the divided apparatus bodies is sealed by a cramp to prevent pressure steam from leaking from the joint part between the apparatus bodies.

Also, a plate member 50 enclosed by a plate material and an external wall member 40 are arranged so as to cover the structural members constituting the pressure steam treatment 10 and labyrinth sealing chamber 20 of the treatment apparatus 1 shown in FIG. 1 and FIG. 2. The bonding surfaces of the plate member 50 and external wall member 40 are all bonded by soldering. These plate member 50 and external wall member 40 can reduce the deformation of the apparatus caused by the pressure applied to the members forming the pressure treatment section 10 and labyrinth sealing chamber 20 from the pressure steam used to treat the fiber bundles Z, and therefore, a rectangular-shaped opening section 26 having uniform height can be obtained.

Figure 5:
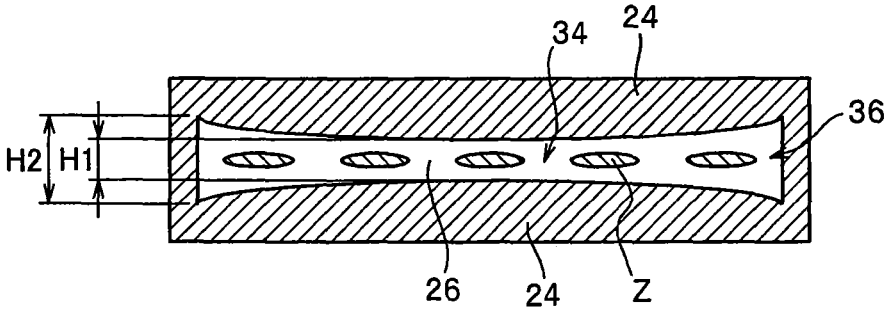
FIG. 5 is a vertical and sectional view showing the state of the structural part of a labyrinth nozzle of a labyrinth sealing chamber shown in FIG. 2 during pressure steam treatment.

If, in the rectangular-shaped opening section 26, the height of the center is the same as that of the end in the direction of the width of the opening section 26, as shown in FIG. 4, this is preferable because pressure steam can be uniformly sealed. However, a temperature difference between the top board or bottom board and the external wall member is caused by heat, with the result that a difference (ΔH) in height arises between the center height H1 and the end height H2 in the direction of the width of the rectangular-shaped opening section 26 as shown in FIG. 5.

In the treatment apparatus 1, when the temperature of the labyrinth sealing chamber 20 is 120° C. to 160° C. (particularly in the situation when the ambient temperature of the labyrinth sealing chamber 20 is 140° C.), the above ΔH can be reduced to 0.5 mm or less by efficiently conducting the heat of the pressure steam treatment chamber 10 and labyrinth sealing chamber 20 to the external wall member 40. This brings about difficulty in the rise of difference in the flow of pressure steam in the center and the end in the direction of the width of the rectangular-shaped opening section 26, so that heat is uniformly applied to a fiber flux, with the result that a fiber flux having uniform quality is easily obtained. In this point, ΔH is designed to be more preferably 0.25 mm or less.

If a difference in temperature between an optional point on the top and bottom boards 11*a* and 11*b* of the pressure steam treatment chamber 10 and the labyrinth sealing chamber 20 and a point on the external wall member opposite to the above optional point is 30° C. or less when the temperature of the pressure steam treatment chamber 10 and labyrinth sealing chamber 20 is 100° C. to 160° C. (particularly in the situation when the ambient temperature of the labyrinth sealing chamber 20 is 140° C.), this is preferable because warpage caused by thermal expansion is limited. In this point, the temperature difference is more preferably 25° C. or less and even more preferably 20° C. or less.

Also, the external wall member 40 is preferably a member having a higher linear expansion coefficient than each linear expansion coefficient of the members of the top and bottom boards 11*a* and 11*b* to limit the difference in thermal expansion and restrain the warpage even if a temperature difference between the top board 11*a* or bottom board 11*b* and the external wall member 40 arises. Which member to select as the member having a different linear expansion coefficient may be optionally selected based on a temperature difference between the top board 11*a* or bottom board 11*b* and the external wall member 40.

Also, in the plate member 50, heat conductive members 44 and 46 are installed between the member constituting the pressure steam treatment chamber 10 and labyrinth sealing chamber 20 and the external wall member 40. Although a material having a heat conductivity of 16 W/(m·K) or more is preferably used as the material of the heat conductive members 44 and 46 and iron steel, stainless steel, aluminum alloy, or the like may be used, no particular limitation is imposed on it.

The temperature difference between the structural members constituting the pressure steam treatment chamber 10 and labyrinth sealing chamber 20 and the external wall member 40 is dropped by the heat conductive effect of the heat conductive members 44 and 46, so that the warpage of the apparatus is decreased, and therefore, the uniform height H of the opening section 26 is kept, thereby more reducing the difference ΔH between the height H1 at the center and the height H2 of the end in the direction of the width of the opening section 26.

The heat conductive members 44 and 46 disposed between the structural members (top and bottom boards 11*a* and 11*b*) constituting the pressure steam treatment chamber 10 and labyrinth sealing chamber 20 and the external wall member 40 are preferably formed such that the ratio (A2/A1) of the sectional area A2 of the heat conductive member to the area A1 enclosed by the plate member 50 with respect to an optional sectional surface parallel to the external wall member 40 is 5% or more. Also, the heat conductive members 44 and 46 are preferably formed such that the above ratio (A2/A1) is 33% or less.

Figure 10:
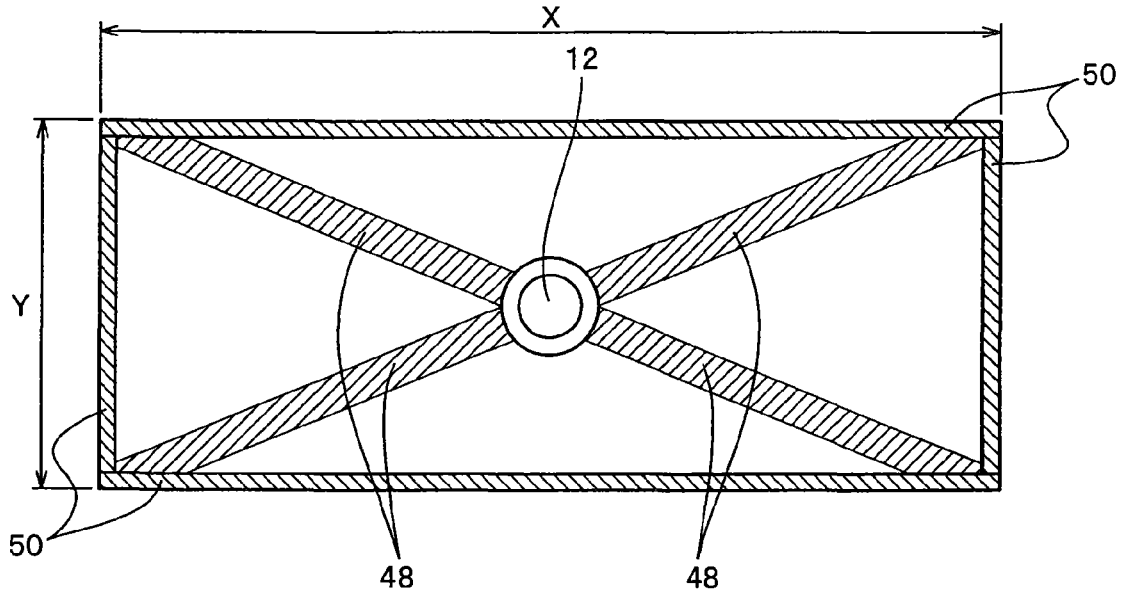
FIG. 10 is a sectional view showing the arrangement of heat conductive members inside of a plate member of a pressure steam treatment apparatus in Example 11.
Figure 11:
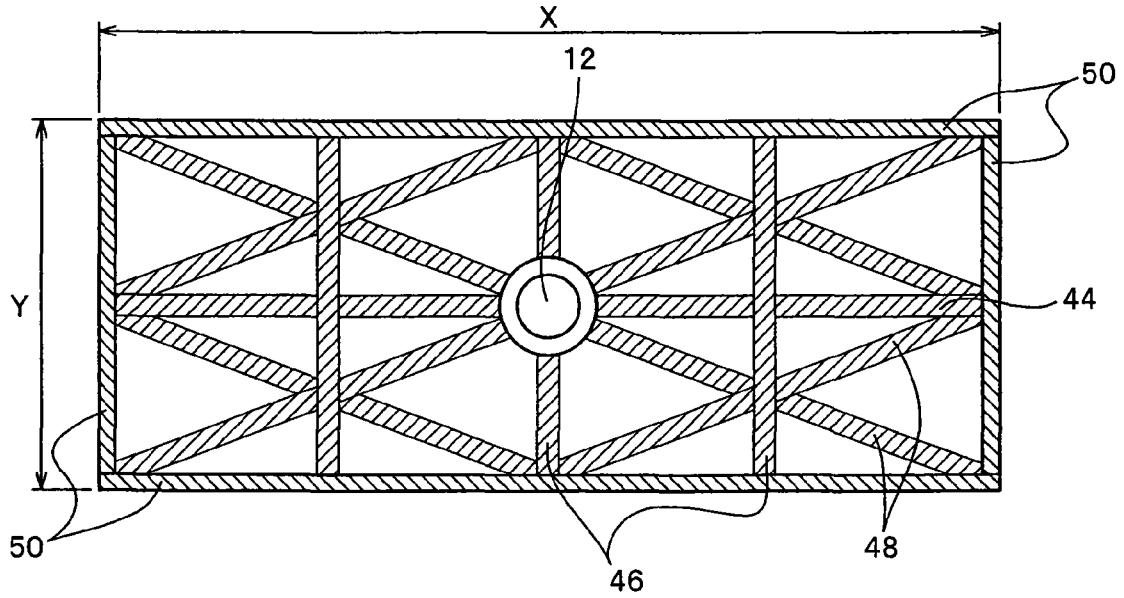
FIG. 11 is a plan and sectional view showing the arrangement of heat conductive members inside of a plate member of a pressure steam treatment apparatus in Example 12.

In the treatment apparatus 1, the heat conductive members are projected from and perpendicularly to the above top board 11*a* and bottom board 11*b* of the pressure steam treatment chamber 10 and labyrinth sealing chamber 20. The heat conductive members in the illustrated example (reference numerals 44 and 46 in FIGS. 1 and 2) seems to have a rib-like form and arranged in the plural each in the direction of running fiber bundles and in a direction parallel to a direction in which the rows of fiber bundles are arranged to exhibit a grid-like form, but this structure is not intended to be limiting of the invention. One or a plurality of heat conductive member 44 may be only arranged in parallel to the direction of running fiber bundles with respect to the top and bottom boards 11*a* and 11*b* constituting the pressure steam treatment chamber 10 and labyrinth sealing chamber 20 (see FIGS. 6 and 7), or one or a plurality of heat conductive members 46 may be only arranged in parallel to a direction in which the row of fiber bundles are arranged (see FIGS. 8 and 9). Moreover, as shown in FIG. 10, a plurality of heat conductive members 48 may be arranged diagonally to the direction of running fiber bundles. Also, as shown in FIG. 11, pluralities of heat conductive members 44 and 46 may be each arranged in parallel to the direction of running fiber bundles and to a direction in which the row of fiber bundles are arranged and also, the heat conductive member 48 may be arranged diagonally to the direction of running fiber bundles.

When the heat conductive members 44 and 46 are each arranged in parallel to the direction of running fiber bundles and to a direction in which the row of fiber bundles are arranged in the plate member 50, the difference between the amount of thermal expansion of the structural members constituting the pressure steam treatment chamber 10 and labyrinth sealing chamber 20 and that of the external wall member 40 is reduced, enabling reduction in the warpage of the apparatus, and therefore, an opening section 26 having a uniform height H is obtained.

Also, the interval between the heat conductive members 44 and 46 each arranged in parallel to the direction of running fiber bundles and to a direction in which the row of fiber bundles are arranged is preferably 100 mm to-500 mm. When the interval between the heat conductive members 44 and 46 is 500 mm or less, the heat given from pressure steam used to treat fiber bundles Z to the structural members forming the pressure steam treatment chamber 10 and labyrinth sealing chamber 20 can be efficiently conducted to the external wall member 40, thereby making possible to reduce the heat deformation of the pressure steam treatment apparatus. When the heat conductive member 48 arranged diagonally is further added, the deformation of the pressure steam treatment apparatus can be more reduced because the heat is evenly transferred to the external wall member 40. When the interval between the heat conductive members 44 and 46 is 100 mm or more, the amount of the structural materials to be used can be decreased to a minimum, and a rise in apparatus cost can be suppressed because increase in the size of the opening/closing mechanism with increase in the weight of the apparatus itself can be limited.

It is preferable to fill the space formed by the plate member 50, pressure steam treatment chamber 10, and labyrinth sealing chamber 20 with insulation material to restrain heat radiation to the air from the plate member 50 and external wall member 40. As the insulation material to be filled, glass wool, rock wool, and the like may be used, though no particular limitation is imposed on the insulation material. The existence of the insulation material can improve the heat efficiency of the pressure steam treatment chamber 10 and labyrinth sealing chamber 20 in the inside and at the same time, efficiently restrain heat radiation to the air from the plate member 50 and external wall member 40.

Any material may be used as the material of the plate member 50 and external wall member 40 without any particular limitation insofar as it is a material having mechanical strength enough to stand against the pressure of the pressure steam. An iron steel material with antirust coat, stainless steel, specific Invar alloys having a low linear expansion coefficient, and the like may be used.

Any material may be used as the material of the heat conductive members 44, 46 and 48 without any particular limitation insofar as it is a material having mechanical strength enough to stand against the pressure of the pressure steam and high heat conductivity. An iron steel material with antirust coat, stainless steel, specific Invar alloy having a low linear expansion coefficient, and the like may be used.

Figure 14:
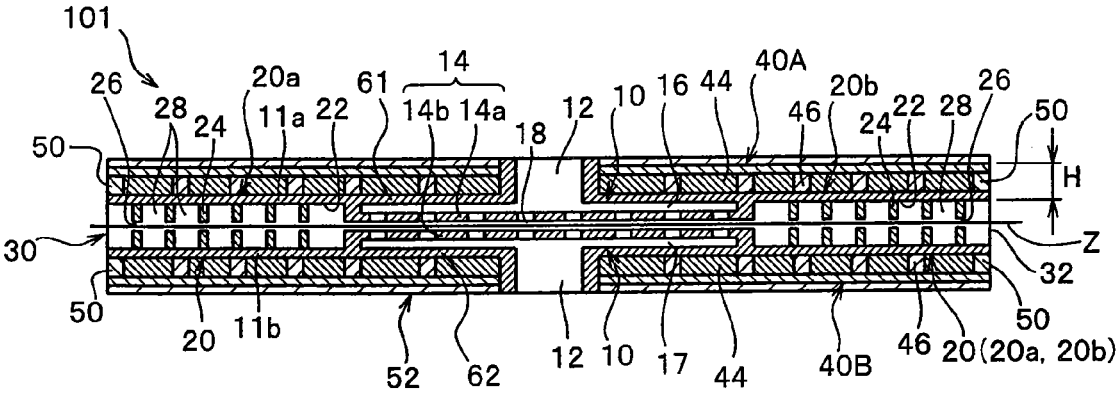
FIG. 14 is a vertical sectional view showing the schematic structure of a pressure steam treatment apparatus 101 used in Examples 15 and 19.
Figure 15:
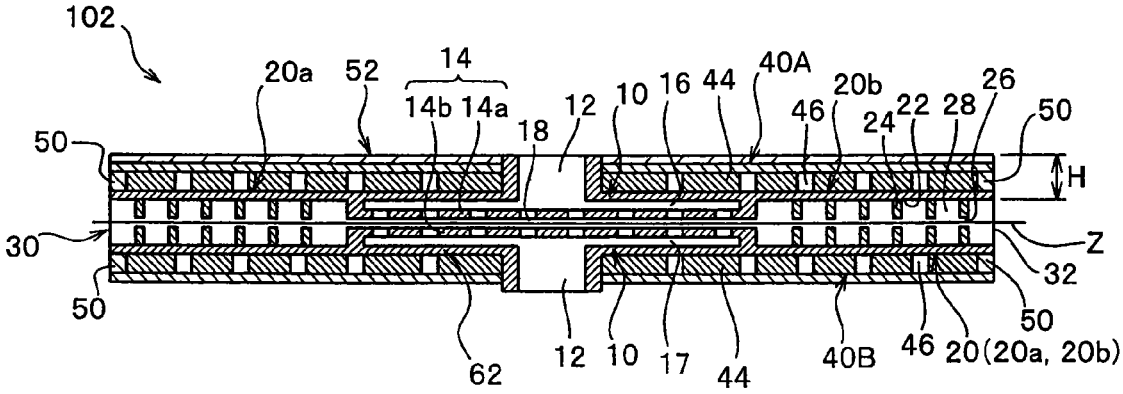
FIG. 15 is a vertical and sectional view of a pressure steam treatment apparatus 102 used in Example 25.

Next, a pressure steam treatment apparatus according to a second embodiment will be explained. FIG. 14 is a vertical and sectional view of a treatment apparatus 101 according to a second embodiment. In this pressure steam treatment apparatus 101, the same reference numerals are used for parts and members having the same structure as those used in the pressure steam treatment apparatus 1 according to the aforementioned first embodiment, thereby omitting detailed explanations of these parts and members.

A pressure steam treatment apparatus 101 shown in FIG. 14 is provided with a pressure steam treatment chamber 10 for treating many sheet-like fiber bundles Z by pressure steam and with a primary side and secondary side labyrinth sealing chambers 20*a* and 20*b* arranged respectively adjacent to each other on the front and back sides in the direction of running fiber bundles in the pressure steam treatment chamber 10.

When adopting the structure obtained by dividing the treatment apparatus 101 into two bodies, there is no particular limitation to an opening/closing mechanism of the divided apparatus bodies 61 and 62, and, for example, a mechanism in which the divided apparatus bodies 61 and 62 are linked by a hinge to switch the opening/closing of the both may be adopted. Also, a method may be adopted in which the divided upper apparatus body section 61 is lifted to open/close. In such a case, it is preferable to make a structure in which the joint part between the divided apparatus bodies is sealed by a cramp to prevent pressure steam from leaking from the joint part between the apparatus bodies.

Also, the apparatus body constituting the pressure steam treatment chamber 10 and labyrinth sealing chamber 20 of the treatment apparatus 101 is enclosed by a plate-shaped upper and lower frame material (plate member) 50 in such a manner as to cover the apparatus body along the upper and lower peripheral surfaces, and the same prismatic members 44 and 46 are assembled grid-wise in a space part enclosed by the above upper and lower frame member 50 excluding a pressure steam inlet 12. Also, external wall members 40A and 40B are fixedly disposed on the upper and lower external side surfaces of the upper and lower frame materials and the prismatic members 44 and 46 respectively.

Here, either the same or different material may be used for the prismatic members 44, 46 and 48 with great heat conductivity which are arranged on the upper and lower external surfaces and left and right external surfaces of the apparatus body. With regard to the prismatic members arranged grid-wise on the upper and lower external surfaces and left and right external surfaces of the apparatus body, the same raw material or different raw material may be combined prior to use.

A heating device is arranged in each of the above upper and lower external wall members 40A and 40B. In the pressure steam treatment apparatus 101 in this embodiment, a steam heater 52 is used as the above heating device. However, there is no particular limitation to the heating device and any heating method may be used insofar as it can heat a member to be heated to a desired temperature. For example, besides the steam heater 52, a cease heater, aluminum casting heater, brass casting heater, or rubber heater may be adopted. The space between the heater 52 and the treatment apparatus 101 may be filled with thermo-cement or the like to improve the efficiency of heat conductivity to the upper and lower external wall members 40A and 40B from these heaters.

Also, in the treatment apparatus 101 according to this embodiment, a heating device is disposed on the entire surface of the upper and lower external members 40A and 40B. However, no particular limitation is imposed on the arrangement of the heating device insofar as the heating device are arranged at the position where the upper and lower wall members 40A and 40B are cooled due to a temperature difference from that of the peripheral atmosphere. For example, heating device are arranged inside of the upper and lower external wall members 40A and 40B. Specifically, the heating device may be arranged either only in the upper external wall member 40A on the upper side of the apparatus body or only in the lower external wall member 40B on the lower side of the apparatus body. Also, a heating device may be formed only in a part of the upper and lower external wall members 40A and 40B. The formation of heating devices other than pressure steam for the pressure steam treatment apparatus makes it possible to compensate temperature drop caused by the heat radiation of the upper and lower external wall members 40A and 40B, so that the whole apparatus is thermally expanded uniformly, with the result that the unevenness caused by a variation in the height of the opening section 26 formed by the labyrinth nozzle 24 can be reduced.

Though no particular limitation is imposed on the heating temperatures of the upper and lower external wall members 40A and 40B heated by the heating device, it is preferable to select a temperature optimum to secure a desired height of the opening section from the temperature of the steam supplied to the inside of the pressure steam treatment chamber 10, the width of the opening section 26, and sum of all length of the pressure steam treatment chamber 10 in the direction of running fiber bundles and all length of the primary side and secondary side labyrinth sealing chambers 20*a* and 20*b*. Also, a method may be adopted in which the distribution of the heating temperature of the member to be heated by the heating device is all fixed or a method may be adopted in which the temperature of only part of the members is dropped, or a method may be adopted in which the temperature of the members is continuously varied corresponding to the temperature of the steam in the labyrinth sealing chamber 20. A temperature control device that receives detection signals from the above various positions and controls the temperature of a necessary position in the labyrinth sealing chamber 20 to a desired temperature is disposed outside of the treatment apparatus 101.

In this embodiment, a temperature detection device that detects the heating temperature of a member to be heated is installed to control the temperature in the above-mentioned labyrinth sealing chamber 20. This temperature detection device is preferably installed at a position where the temperature of the body can be directly measured in the upper and lower external wall members 40A and 40B. For this, in this embodiment, a temperature detection device is installed at one or plural positions in the labyrinth sealing chamber 20. As a method of detecting the heating temperature of the heating device, for example, many thermocouples are used. However, the detection method is not limited to this and any method may be used without any particular limitation insofar as it can detect the temperature exactly in a desired temperature range.

The treatment apparatuses 1 and 101 are not limited to the treatment apparatuses 1 and 101 illustrated in FIGS. 1 to 3 and FIG. 14. For example, the treatment apparatuses 1 and 101 of the illustrated examples are apparatuses in which the fiber bundles Z are made to run in a horizontal direction. However, the treatment apparatuses 1 and 101 maybe respectively a pressure steam treatment apparatus in which the fiber bundles Z are made to run in a vertical direction.

The fiber bundles Z may be properly selected corresponding to use, and examples of the fiber bundles Z include fiber bundles used to manufacture carbon fibers such as fiber bundles obtained by spinning a yarn raw solution containing a polyacrylonitrile polymer to form spun fibers, which are then drawn in a bath, followed by drying to densify. In this embodiment, a yarn raw solution containing a polyacrylonitrile polymer is spun to form a solidified fibers, which are then drawn in a bath, followed by drying to densify, thereby obtaining fiber bundles which are precursor fibers of carbon fiber and the fiber bundles are then subjected to a secondary drawing process performed under a pressure steam atmosphere to obtain fiber bundles Z of a polyacrylonitrile type fiber flux made of multifilament.

Although the treatment apparatuses 1 and 101 are not particularly limited by the type of the fiber bundles Z of fibers made of a polyacrylonitrile type polymer to be applied and treatment processes, they may be preferably used for a drawing apparatus or drawing method in the case of obtaining fine size fibers or fibers having high orientation and in the case where high spinning speed is required. Particularly, the treatment apparatuses 1 and 101 maybe preferably used in a drawing process in the production of polyacrylonitrile type polymer fibers for carbon fibers.

EXAMPLES

The invention will be explained in detail by way of examples and comparative examples. However, the invention is not limited by the following descriptions. In the following Examples 1 to 14 and Comparative Example 1 and 2, a difference ΔH (=H2−H1) between the height H1 of the section at the center 34 of the opening section shown in FIG. 5 and the height H2 of the section at each end 36 of the opening section was calculated and a variation ΔH of the height H caused by the thermal deformation of the treatment apparatus was calculated at intervals of 10 mm along the direction of running fiber bundles by numerical analysis using the finite element method. The calculated ΔH was evaluated based on the standard shown in Table 1 to estimate the performance as a multi-spindle batch process apparatus. The results are shown in FIG. 24A and FIG. 24B. As to the difference ΔT in temperature between an optional point of the top board 11*a* and bottom board 11*b* of the pressure steam treatment chamber 10 and labyrinth sealing chamber 20 and a point of the opposite external wall member 40, temperatures at predetermined positions were measured to evaluate, and a maximum temperature difference $\Delta T_M$ was calculated.

TABLE 1

| ΔH [mm] | Rating |
|---|---|
| Less than 0.25 | ◎ |
| 0.25 or more and less than 0.4 | ○ |
| 0.4 or more and less than 0.5 | Δ |
| 0.5 or more | X |

In Examples 15 to 26, the influence of unevenness of the height H of the opening section 26 caused by the deformation of the pressure steam treatment apparatus 101 was evaluated by measuring the frequency of the raise of fuzz on the fiber bundle. The evaluation of the frequency of the raise of fuzz on the fiber bundle was made according to the following method. Specifically, the number of fuzz generated per hour in plurality of running fiber bundles drawn and discharged from the pressure steam treatment apparatus was measured visually to calculate an average number of raises of fuzz per fiber bundle. The standard of evaluation is shown in Table 2. The average number of raises of fuzz on the fiber bundle was calculated by the following equation. (Average number of raises of fuzz on the fiber bundle)=(Total number of fuzz raised per hour in a plurality of running fiber bundles drawn and discharged from the pressure steam treatment apparatus)/(Number of fiber bundles charged to the pressure steam treatment apparatus)

TABLE 2

| Average number of fuzz raised on the fiber bundle | Evaluation |
|---|---|
| Less than 0.5 | ◎ |
| 0.5 or more and less than 2 | ○ |
| 2 or more and less than 10 | Δ |
| 10 or more | X |
| Unable spinning | XX |

The unevenness of the height of the opening section 26 in the direction of the width in each of Examples 15 to 26 was a maximum among the differences ΔH=(H2−H1) between the height H1 of the section at the center 34 of the section of the opening section 26 and the height H2 of the section at each end 36 of the section of the opening section 26, these heights being found, as shown in FIG. 5, by inserting a 3 mmφ lead wire on all plate fragments constituting the center 34 of the opening section between the upper and lower labyrinth nozzles and both ends 36 of the opening of the labyrinth nozzle of the pressure steam treatment apparatus 101 and by measuring the thickness of the smashed part of the lead wire, and the maximum difference in height was evaluated as a ratio ($\Delta H_{max}$/W) to the width W of the opening section.

Production Example 1

A polyacrylonitrile type polymer obtained by copolymerizing acrylonitrile (AN), methylacrylate (MA) and methacrylic acid (MAA) in a molar ratio of AN/MA/MAA=96/2/2 was dissolved in a dimethylacetamide (DMAc) solution (polymer concentration: 20 mass %, viscosity: 50 Pa·s, temperature: 60° C.) to prepare a yarn raw solution. The yarn raw solution was discharged in an aqueous DMAc solution having a concentration of 70% by mass and a liquid temperature of 35° C. through a spinneret having 12000 holes. The obtained spun fiber was washed with water, then drawn at a draw ratio of 3 times, and dried at 135° C. to obtain densified fiber bundles Z.

Example 1

The treatment apparatus 1 illustrated in FIGS. 1 and 2 was designed to have the following dimensions: total length X of the apparatus 1: 4000 mm, total length of the pressure steam treatment chamber 10 in the direction of running fiber bundles Z: 1000 mm, total length of the labyrinth sealing chamber 20 in the direction of running fiber bundles Z: 1500 mm, width Y of the treatment apparatus: 1050 mm, height H of the rectangular-shaped opening section 26: 2 mm, and width W of the opening section 26: 1000 mm. In this case, the total length of the treatment apparatus 1 is the sum of each total length of the pressure steam treatment chamber 10 and two (first and second) labyrinth sealing chambers in the direction of running fiber bundles. Specifically, the total length of the labyrinth sealing chamber 20 is each length of the first and second seal sections 20 on one side thereof, and the first and second labyrinth sealing chambers 20 having this total length are arranged on each of the front and back of the pressure steam treatment chamber 10.

As the heat conductive member 44 arranged in parallel to the direction of the running fiber bundles Z, two plate materials having a plate thickness of 21 mm were disposed rib-like at equal intervals (350 mm pitch), and as the heat conductive member 46 arranged in parallel to a direction in which the row of fiber bundles are arranged. 12 plate materials having a plate thickness of 12 mm were disposed at equal intervals (300 mm pitch) so as to cross with the heat conductive member 44. A plate material having a plate thickness of 25 mm was used as the plate member 50, a plate material having a plate thickness of 21 mm was used as the external wall member 40 and a plate material having a plate thickness of 25 mm was used as the structural members of the pressure steam treatment chamber 10 and labyrinth sealing chamber 20. The treatment apparatus enclosed by the structural members of the pressure steam treatment chamber 10 and labyrinth sealing chamber 20, the plate member 50 and the external wall member 40 was designed to have a height of 300 mm. The ratio (A2/A1) of the sectional area A2 of the heat conductive member to the area A1 enclosed by the plate member 50 in this treatment apparatus was designed to be 7.5%. In this case, the labyrinth nozzle 24 and porous plate 14 were neglected in order to simplify the calculation.

As the physical properties of each of the plate member 50, external wall member 40, heat conductive members 44 and 46, pressure steam treatment chamber 10, and labyrinth sealing chamber 20, the physical properties of general iron steel (modulus of longitudinal elasticity=206 GPa, modulus of transverse elasticity=79 GPa, and linear expansion coefficient $\gamma=11.7\times10^{-6}$ [/° C.]) were used.

The pressure and temperature in the structural member of the pressure steam treatment chamber 10 were set to 300 KPaG and 142° C. respectively and the pressure applied to the inside of the structural member of the labyrinth sealing chamber 20 descends towards the fiber bundle inlet 30 and fiber bundle outlet 32 from the first and second labyrinth sealing chambers 31 and 33. The temperature applied to the inside of the member forming the labyrinth sealing chamber 20 was made to be steam saturation temperature at the above proportionally descending pressure. In this example, the pressure proportionally descends such that the pressure of the first and second labyrinth sealing chambers 31 and 33 is 300 KPaG and the pressure of the fiber bundle inlet 30 and fiber bundle outlet 32 is 0 KPaG. Also, the temperature of the first and second labyrinth sealing chambers 31 and 33 is set to 142° C. and the temperature of the fiber bundle inlet 30 and fiber bundle outlet 32 is set to 100° C.

The heat transfer coefficient between the inner surface of the plate member 50, the surface of the heat conductive member 44 parallel to the direction of running fiber bundles, and the surface of the heat conductive member 46 parallel to a direction in which the row of fiber bundles are arranged and the space section was set to 3 W/($m^2$/K) and the temperature of the space section was set to 80° C. The heat transfer coefficient between the external surface of the plate member 50 and the space section was set to 10 W/($m^2$/K) and the temperature of the space section was set to 60° C. Here, W is the width of the rectangular-shaped opening section of the labyrinth nozzle.

Numerical analysis of an analog having a size of/1;8 that of the aforementioned form was made, and as a result, ΔH was 0.212 mm and ΔT=18° C. (See FIG. 24A and FIG. 24B).

Examples 2 to 5

Numerical analysis was made using the same condition as that of Example 1 except that the thicknesses and number of the heat conductive members 44 and 46 and the ratio (A2/A1) of the sectional area A2 of the heat conductive member to the area A1 enclosed by the plate member 50 with respect to an optional section parallel to the external wall member 40 were altered to those shown in FIG. 24A and FIG. 24B. The obtained results are shown in FIG. 24A and FIG. 24B.

Example 6

Figure 12:
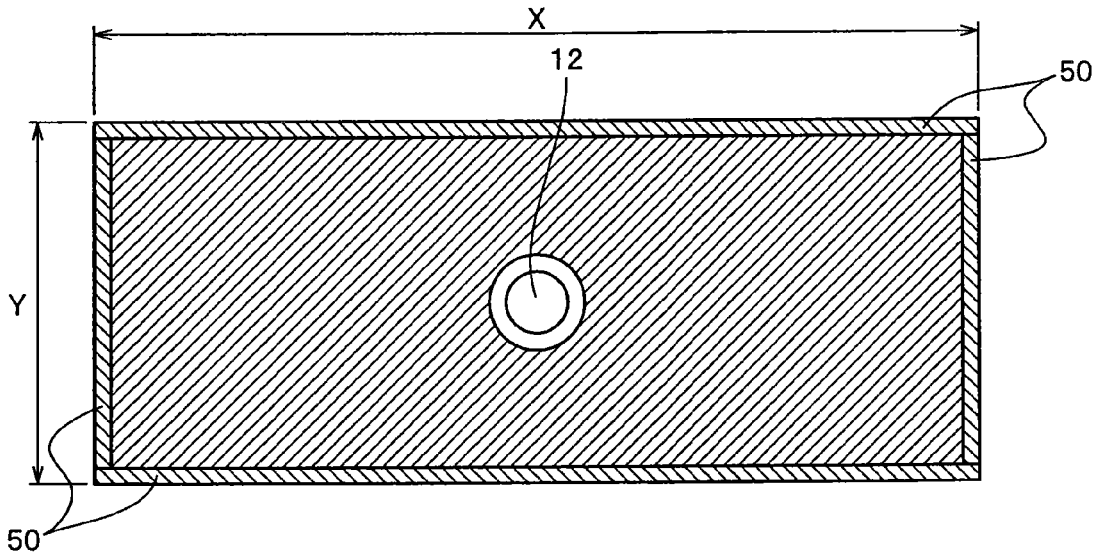
FIG. 12 is a plan and sectional view showing the arrangement of heat conductive members inside of a plate member of a pressure steam treatment apparatus used in Example 6.

Numerical analysis was made using the same condition as that of Example 1 except that all region of the space section formed between the plate member 50 of the treatment apparatus 1 as indicated by the fine shaded hatch in FIG. 12 and the top board 11*a* and bottom board 11*b* of the plate member 50 was filled with a heat conductive member, that is, the ratio (A2/A1) of the sectional area A2 of the heat conductive member to the area A1 enclosed by the plate member 50 was set to 100%. The obtained results are shown in FIG. 24A and FIG. 24B.

Examples 7 and 8

Figure 6:
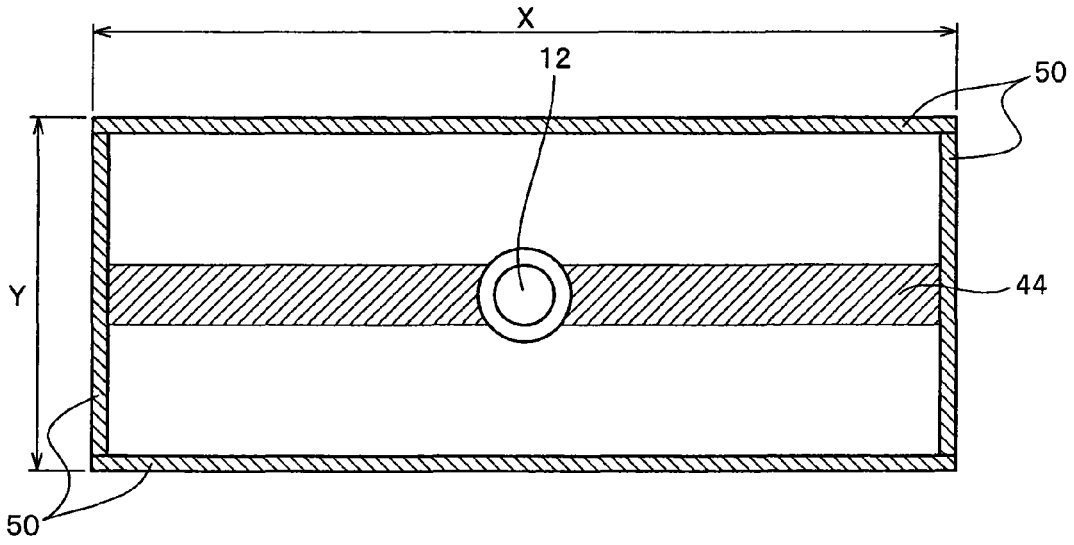
FIG. 6 is a plan and sectional view showing the arrangement of heat conductive members inside of a plate member of a pressure steam treatment apparatus in Example 7.
Figure 8:
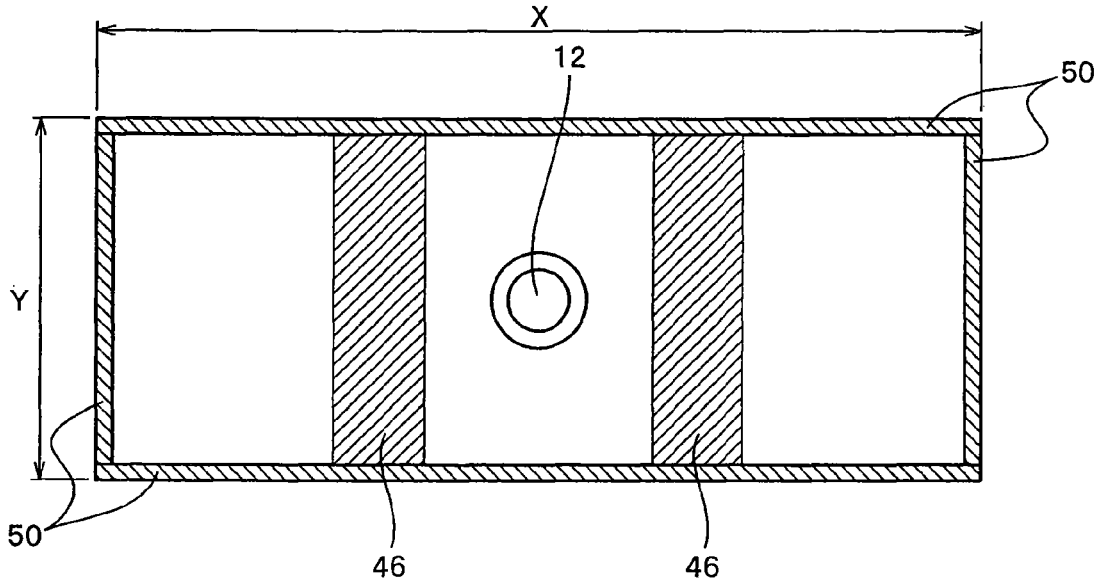
FIG. 8 is a plan and sectional view showing the arrangement of heat conductive members inside of a plate member of a pressure steam treatment apparatus in Example 8.

Numerical analysis was made using the same condition as that of Example 1 except that as illustrated in FIGS. 6 and 8, only one of the heat conductive members 44 and 46 was used as the heat conductive member inside of the plate member 50 and the thickness was altered to that shown in FIG. 24A and FIG. 24B. The results are shown in FIG. 24A and FIG. 24B.

Examples 9 and 10

Figure 7:
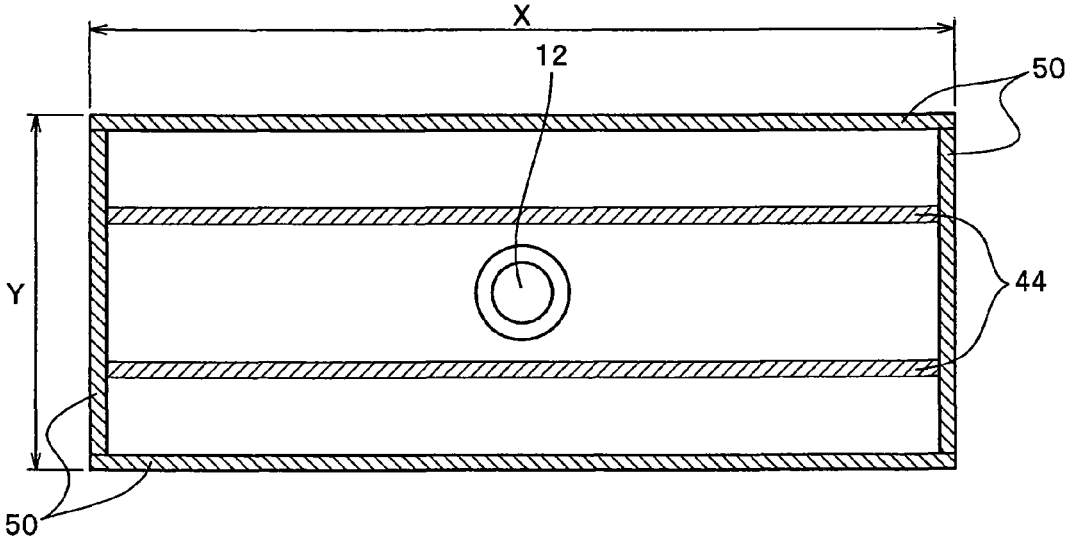
FIG. 7 is a plan and sectional view showing the arrangement of heat conductive members inside of a plate member of a pressure steam treatment apparatus in Example 9.
Figure 9:
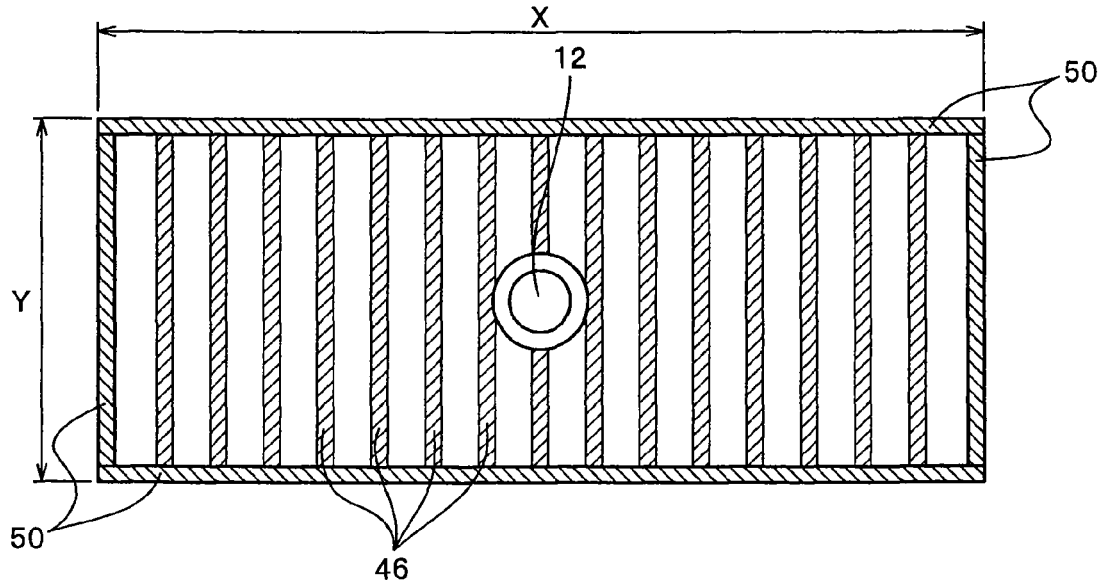
FIG. 9 is a plan and sectional view showing the arrangement of heat conductive members inside of a plate member of a pressure steam treatment apparatus in Example 10.

Numerical analysis was made using the same condition as that of Example 1 except that as illustrated in FIGS. 7 and 9, only one of the heat conductive members 44 and 46 was used as the heat conductive member inside of the plate member 50 and the thickness and the intervals between the members were altered to those shown in FIG. 24A and FIG. 24B. The results are shown in FIG. 24A and FIG. 24B.

Example 11

Numerical analysis was made using the same condition as that of Example 1 except that as illustrated in FIG. 10, only a heat conductive member 48 diagonally arranged was used as the heat conductive member inside of the plate member 50 and the thickness and the intervals between the members were altered to those shown in FIG. 24A and FIG. 24B. The results are shown in FIG. 24A and FIG. 24B.

Example 12

Numerical analysis was made using the same condition as that of Example 1 except that as illustrated in FIG. 11, the heat conductive members 44, 46 and 48 were used as the heat conductive member inside of the plate member 50 and the thickness and the intervals between the members were altered to those shown in FIG. 24A and FIG. 24B. The results are shown in FIG. 24A and FIG. 24B.

Example 13

Numerical analysis was made using the same condition as that of Example 1 except that the total length X of the treatment apparatus 1 was altered to that shown in FIG. 24A and FIG. 24B. The results are shown in FIG. 24A and FIG. 24B.

Example 14

Figure 13:
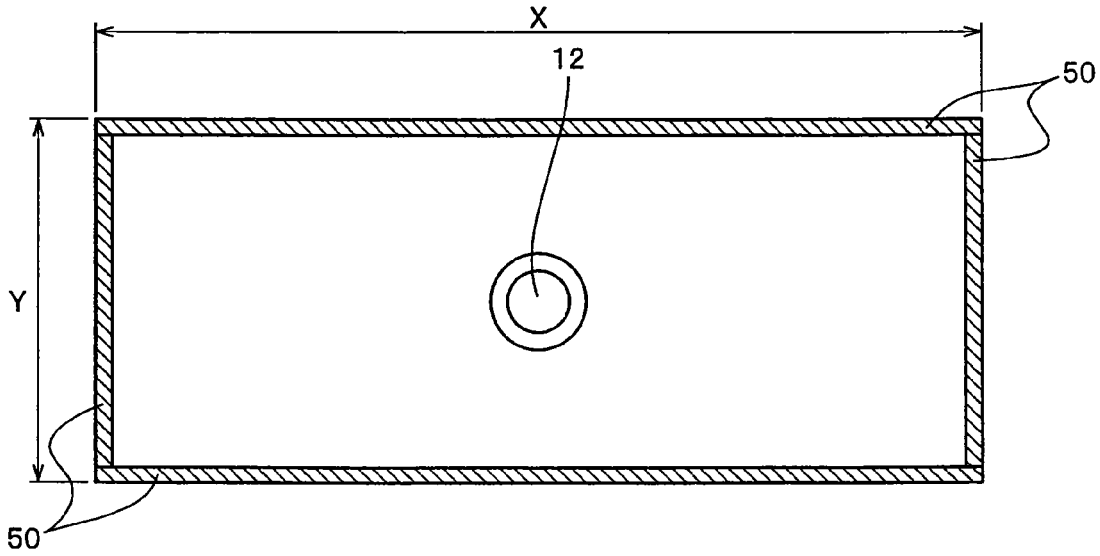
FIG. 13 is an explanatory view of the internal structure of a pressure steam treatment apparatus used in Example 14.

Numerical analysis was made using the same condition as that of Example 1 except that as illustrated in FIG. 13, the heat conductive member was not disposed inside of the plate member 50 and as the physical properties of the external wall member 40, those of stainless steel SUS304 (modulus of longitudinal elasticity =200 GPa, modulus of transverse elasticity =74 GPa and linear expansion coefficient $\gamma=17.8\times10^{-6}$ [/° C.]) were used. The results are shown in FIG. 24A and FIG. 24B.

Comparative Example 1

Numerical analysis was made using the same condition as that of Example 1 except that as illustrated in FIG. 13, the heat conductive member was not disposed inside of the plate member 50. The results are shown in FIG. 24A and FIG. 24B.

Comparative Example 2

Numerical analysis was made using the same condition as that of Example 1 except that the width Y of the treatment apparatus 1 and the width W of the rectangular-shaped opening section of the labyrinth nozzle 24 were altered to those shown in FIG. 24A and FIG. 24B. The results are shown in FIG. 24A and FIG. 24B.

Example 15

Figure 16:
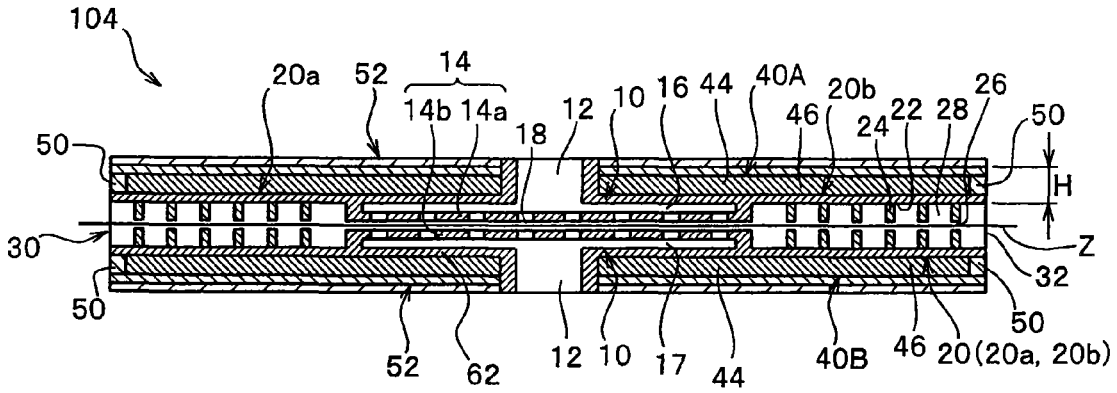
FIG. 16 is an explanatory view of the internal structure of a pressure steam treatment apparatus 104 used in Example 16.
Figure 16:
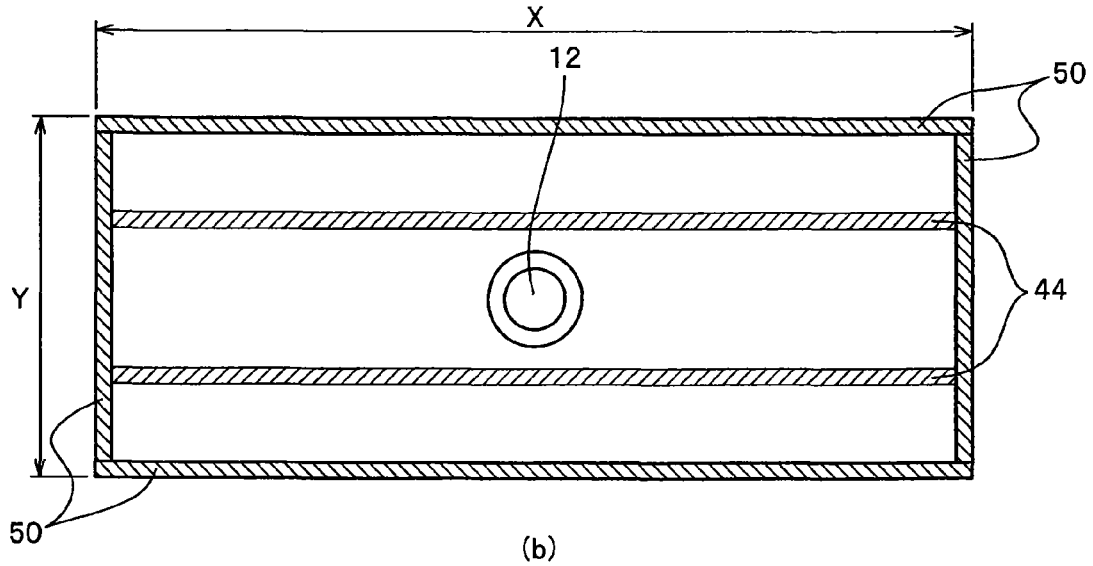

A treatment apparatus 104 was used having the same structure as the treatment apparatus 104 illustrated in FIG. 16 except that a part of the structure was altered as follows: the total length of the pressure steam treatment chamber in the direction of running fiber bundles was 1000 mm, the total length of the labyrinth sealing chamber in the direction of running fiber bundles was 1500 mm (where the total length of the labyrinth sealing chamber was the length of the labyrinth sealing chamber on one side and the labyrinth sealing chamber having this total length was disposed on each of the front and back of the pressure steam treatment chamber. The same as follows), the length L of the labyrinth nozzle projected from the internal wall surface was 5 mm, the pitch P between adjacent labyrinth nozzles was 20 mm, the ratio L/P of the projected length L to the pitch P was 0.25, the number of stages of labyrinth nozzles was 60, the height H of the opening section was 2 mm, the width W of the opening section was 1000 mm, and a plane heater 52 was fixedly installed on one surface of each surface side of the upper and lower external wall materials. Iron steel (linear expansion coefficient $\gamma=11.7\times10^{-6}$ [/° C.]) was used as the material of the apparatus body.

A K-type thermocouple was attached to the surface opposite to the heating surface of the external wall member of the K-type thermocouple to detect the temperature of the external wall member heated by the heater 52.

Using the above treatment apparatus 104, the fiber bundles Z obtained in Production Example 1 was introduced from the fiber bundle inlet on five spindles to carry out pressure steam treatment. The pressure in the pressure room was set to 300 kPa and the pressure and temperature of pressure steam supplied to the heater 52 were controlled such that the temperature of the upper and lower external wall member was 142° C.

The frequency of the raise of fuzz on the fiber bundle after drawn by pressure steam during drawing in the pressure steam treatment apparatus 104 and unevenness of the height of the opening section in the direction of the width were evaluated. The results are shown in FIG. 25B and 25D. In the production of fiber bundles, no fluttering was observed in all fiber bundles and there was no raise of fuzz on the fiber bundle caused by the friction among fluttered fiber bundles at the inlet of the drawing unit, enabling stable steam drawing.

Examples 16 to 20

Pressure steam treatment of the fiber bundles Z was carried out in the same manner as in Example 15 except that the prismatic members 44, 46 and 48 in the treatment apparatuses 104, 107, 110, 101 and 113 were altered as shown in FIG. 25A and 25C as illustrated in FIGS. 16, 18, 20, 14 and 22.

The condition of the raise of fuzz on the fiber bundle after the pressure steam drawing was observed while drawing process was performed in the pressure steam treatment apparatus to evaluate the frequency of the raise of fuzz on the fiber bundle and the unevenness of the height in the direction of the width of the opening section. The results are shown in FIG. 25A to 25D.

Example 21

Figure 17:
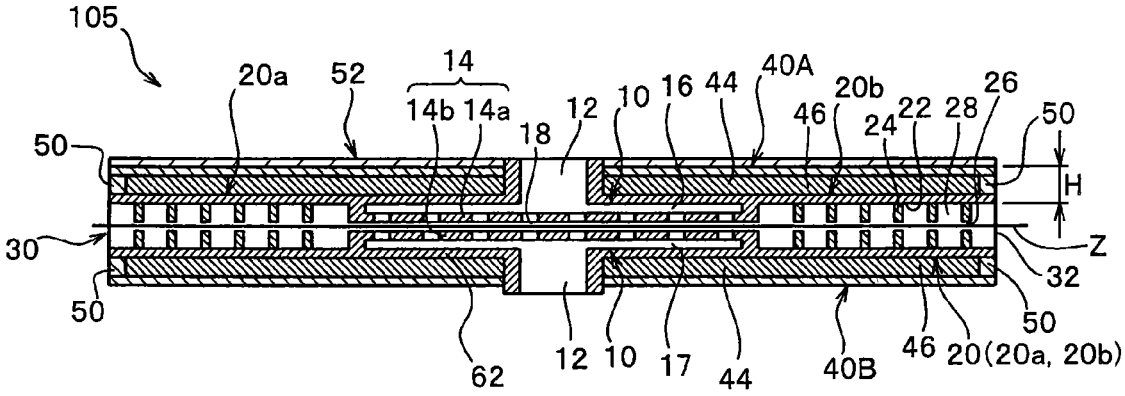
FIG. 17 is a vertical and sectional view of a pressure steam treatment apparatus 105 used in Examples 21 and 22.
Figure 18:
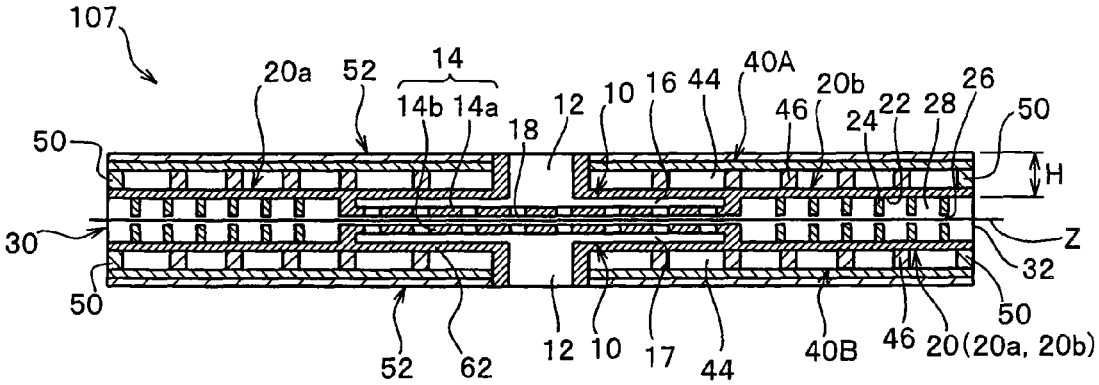
FIG. 18 is an explanatory view of the internal structure of a pressure steam treatment apparatus 107 used in Example 17.
Figure 18:
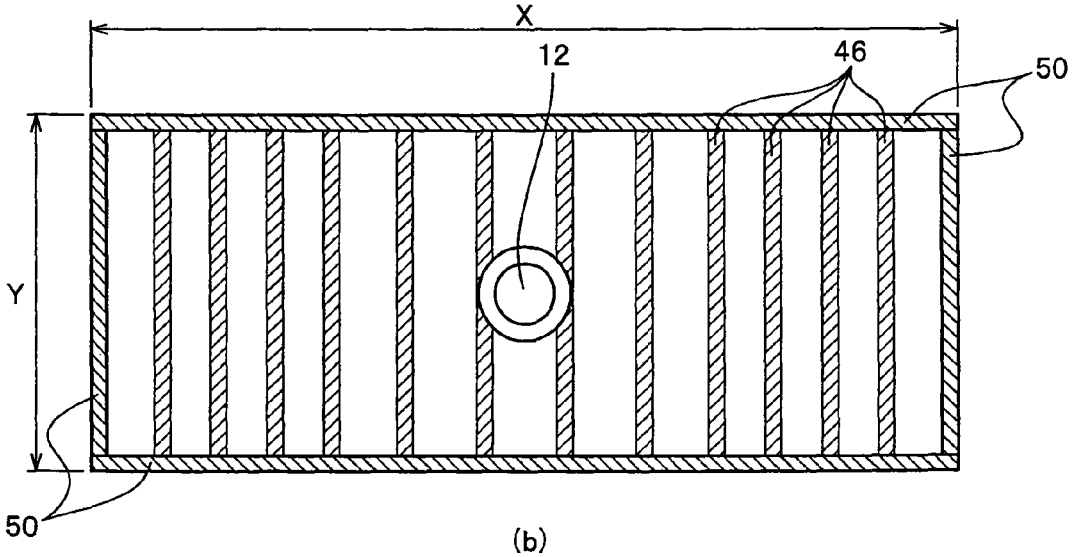
Figure 19:
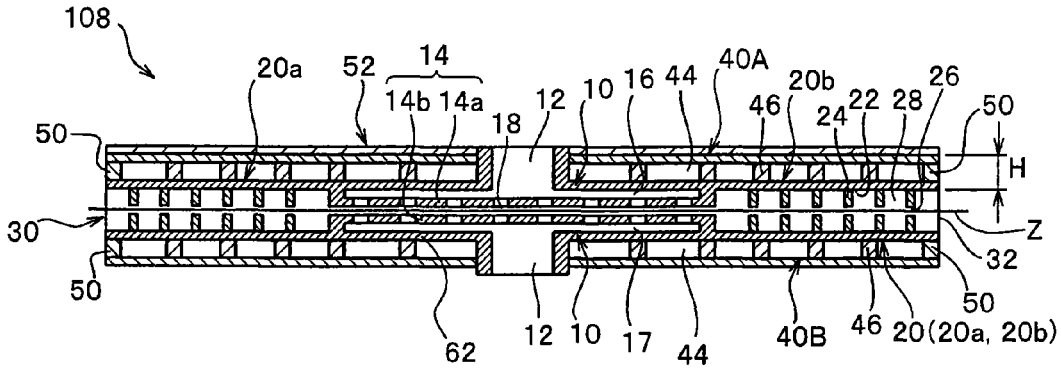
FIG. 19 is a vertical and sectional view of a pressure steam treatment apparatus 108 used in Example 23.
Figure 20:
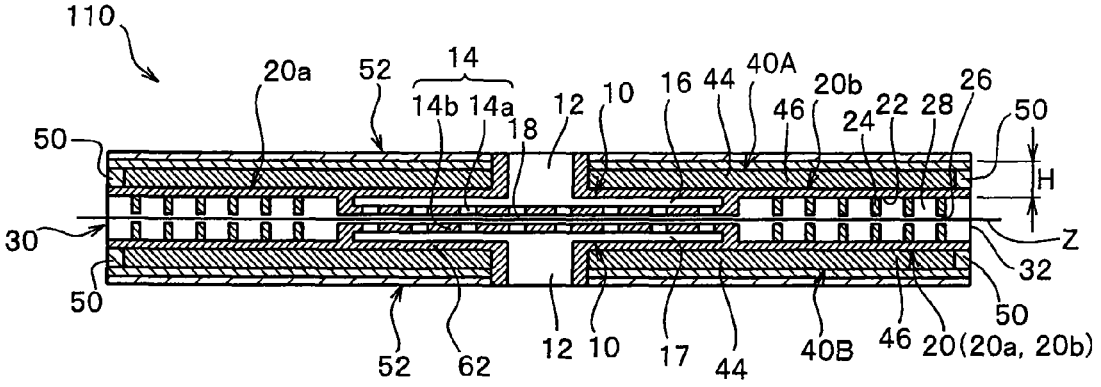
FIG. 20 is an explanatory view of the internal structure of a pressure steam treatment apparatus 110 used in Example 18.
Figure 20:
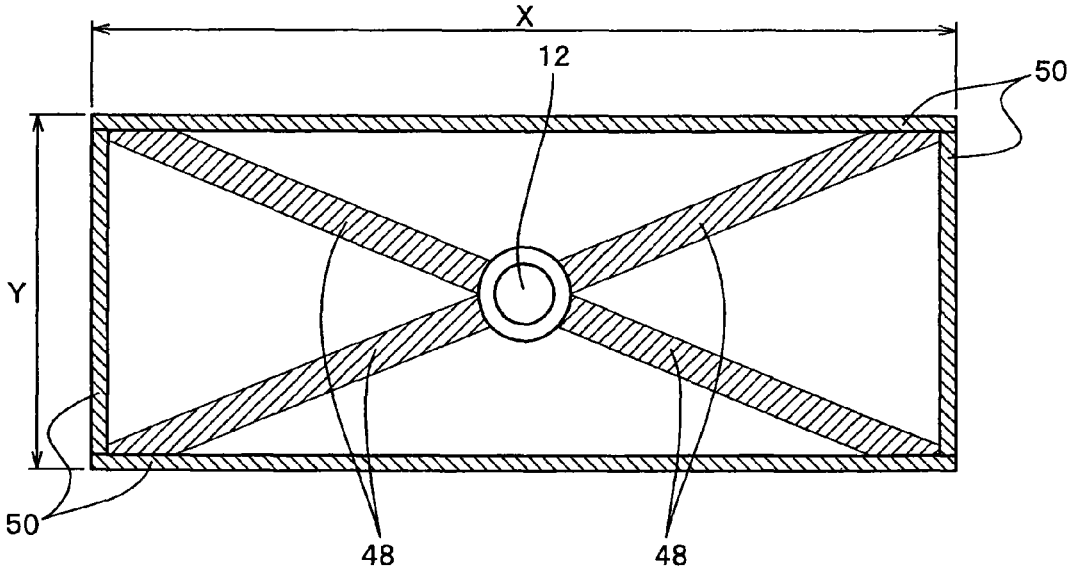
Figure 21:
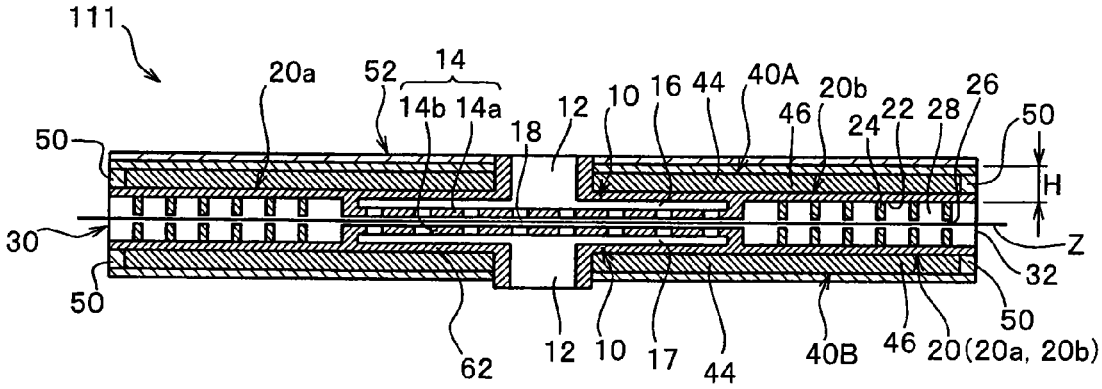
FIG. 21 is a vertical and sectional view of a pressure steam treatment apparatus 111 used in Example 24.
Figure 22:
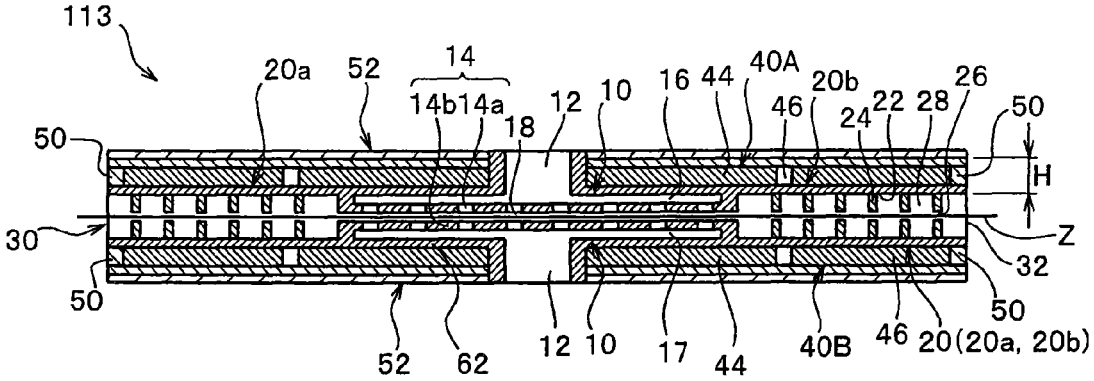
FIG. 22 is an explanatory view of the internal structure of a pressure steam treatment apparatus 113 used in Example 20.
Figure 22:
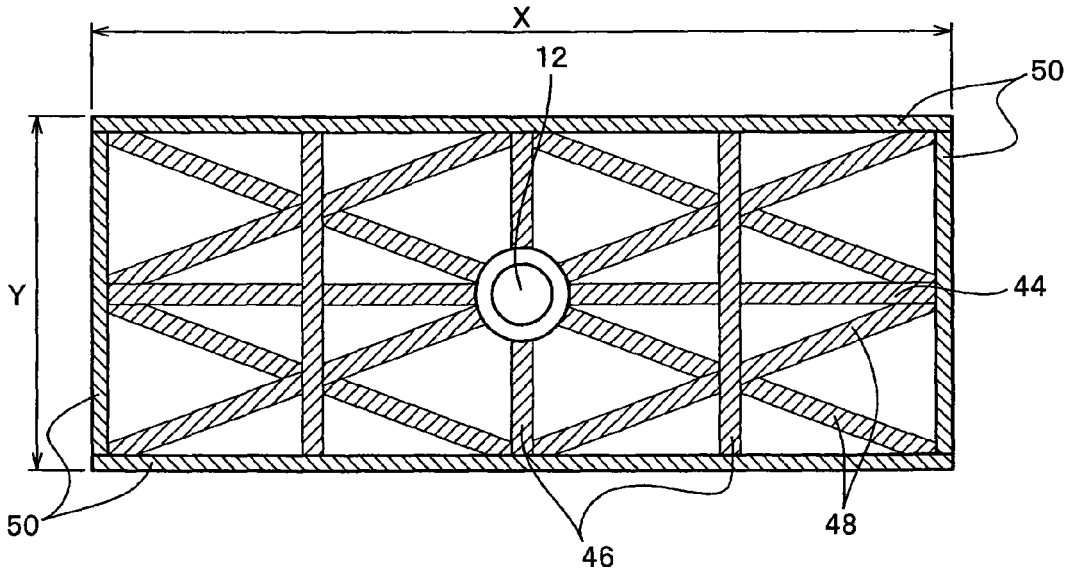
Figure 23:
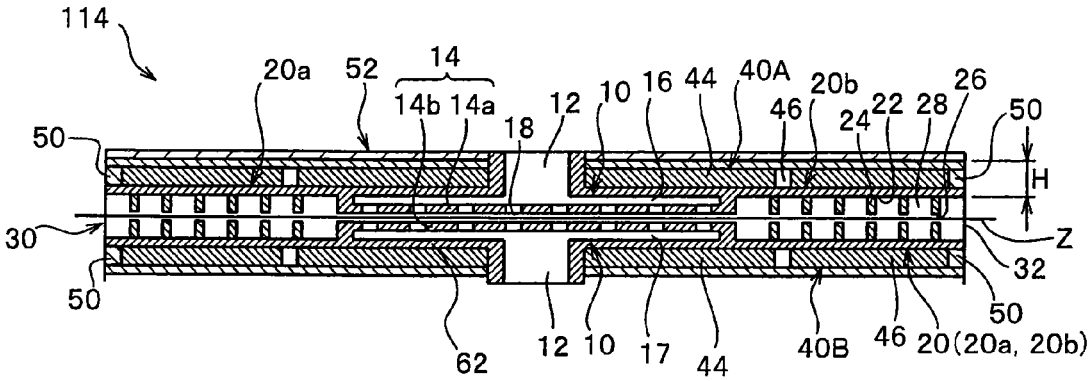
FIG. 23 is a vertical and sectional view of a pressure steam treatment apparatus 114 used in Example 26.

Pressure steam treatment of the fiber bundles Z was carried out in the same manner as in Example 15 except that a treatment apparatus 105 was used in which a heater 52 with one surface having a plane form is stuck only to the upper external wall member 40A as the heating device of the treatment apparatus other than the pressure steam treatment chamber as shown in FIG. 17, and the temperature of the upper external wall member 40A was altered to that shown in FIG. 25B and FIG. 25D.

The condition of the raise of fuzz on the fiber bundle after the pressure steam drawing was observed while drawing process was performed in the pressure steam treatment apparatus 105 to evaluate the frequency of the raise of fuzz on the fiber bundle and the unevenness of the height in the direction of the width of the opening section 26. The results are shown in FIG. 25B and FIG. 25D.

Examples 22 to 26

Pressure steam treatment of the fiber bundles Z was carried out in the same manner as in Example 21 except that the prismatic members 44, 46 and 48 in the treatment apparatuses 105, 108, 111, 102 and 114 were altered as shown in FIG. 25A and 25C as illustrated in FIGS. 17, 19, 21, 15 and 23.

The condition of the raise of fuzz on the fiber bundle after the pressure steam drawing was observed while drawing process was performed in the pressure steam treatment apparatus to evaluate the frequency of the raise of fuzz on the fiber bundle and the unevenness of the height in the direction of the width of the opening section 26. The results are shown in FIG. 25A to 25D.

Comparative Examples 3 to 8

Pressure steam treatment of the fiber bundles Z was carried out in the same manner as in Example 15 except that a treatment apparatus was used which had the same structure as the treatment apparatuses 101, 104, 107, 110, and 113 except that the heater for heating the upper and lower external wall members was not disposed and the temperature of the external wall member 40A was altered to that shown in FIG. 25B and FIG. 25D.

The condition of the raise of fuzz on the fiber bundle after the pressure steam drawing was observed while drawing process was performed in the pressure steam treatment apparatus to evaluate the frequency of the raise of fuzz on the fiber bundle and the unevenness of the height in the direction of the width of the opening section 26. The results are shown in FIG. 25B and FIG. 25D.

DESCRIPTION OF REFERENCE NUMERALS

10: Pressure steam treatment chamber
11*a:* Top board
11*b:* Bottom board
12: Pressure steam inlet
14: Porous plate
16, 17: Pressure room
18: Fiber bundle running path
20: Labyrinth sealing chamber
22: Internal wall surface
24: Labyrinth nozzle
26: (Rectangular-shaped) opening section
28: Expansion room
30: Fiber bundle inlet
31, 33: First and second labyrinth sealing chamber
32: Fiber bundle outlet
34: Center of the section of the opening section
36: Both ends of section of the opening section
40: External wall member
40A, 40B: (Upper/lower) external wall member
44, 46, 48: Prismatic member

50: Upper/lower frame material (plate member)
52: Heater (heating device)
61, 62: (Upper/lower divided) apparatus body sections.

The invention claimed is:

1. A pressure steam treatment apparatus comprising a pressure steam treatment chamber and a labyrinth sealing chamber, wherein:

the labyrinth sealing chamber is arranged on a fiber bundle inlet and on a fiber bundle outlet of the steam treatment apparatus, a running path of a fiber bundle is in a horizontal direction, wherein plural labyrinth nozzles are arranged on top and bottom of the running path; and the labyrinth nozzles comprise a top side labyrinth nozzle and a bottom side labyrinth nozzle located opposite to each other;

a difference between a maximum value and a minimum value of a distance in a perpendicular direction of the top and bottom side labyrinth nozzles, of a pair of opposing labyrinth nozzles is 0.5 mm or smaller when the ambient temperature of the labyrinth sealing chamber is 140° C.

2. The pressure steam treatment apparatus of claim 1, further comprising an external wall member on an upper surface and a lower surface of the pressure steam treatment apparatus excluding a steam inlet, having a plate member extending along a top board of the pressure steam treatment apparatus on an inner surface of an external wall member of an upper surface, and having a plate member extending along a bottom board of the pressure steam treatment apparatus on an inner surface of an external wall member of a bottom surface; and when the ambient temperature of the pressure steam treatment chamber or labyrinth sealing chamber is 140° C., a difference in temperature between an optional point on the top or bottom boards of the pressure steam treatment chamber and one point on the external wall member opposite to the optional point is 30° C. or less.

3. The pressure steam treatment apparatus of claim 2, wherein the external wall member is a member having a linear expansion coefficient higher than linear expansion coefficients of the top board and the bottom board.

4. The pressure steam treatment apparatus of claim 2, wherein a heat conductive member is disposed in a space part between at least the upper surface of the pressure steam treatment chamber and the labyrinth sealing chamber and the external wall member.

5. A pressure steam treatment apparatus comprising a pressure steam treatment chamber and a labyrinth sealing chamber, wherein: the labyrinth sealing chamber is arranged on a fiber bundle inlet and a fiber bundle outlet of the steam treatment apparatus, a running path of a fiber bundle is in a horizontal direction; and the apparatus includes an external wall member on an upper surface and a lower surface of the pressure steam treatment apparatus excluding a steam inlet, having a plate member extending along a top board of the pressure steam treatment apparatus, on an inner surface of an external wall member of an upper surface, and having a plate member extending along a bottom board of the pressure steam treatment apparatus on an inner surface of an external wall member of a bottom surface; and a heat conductive member is disposed in a space part between at least the top board of the pressure steam treatment chamber and the external wall member in an upper direction of the top board.

6. The pressure steam treatment apparatus of claim 4, wherein the space part is parallel to the top board in the space part, and a ratio of a sectional area A2 of the heat conductive member to an area A1 enclosed by the plate member is 5% or more.

7. The pressure steam treatment apparatus of claim 4, wherein the heat conductive member has a heat conductivity of 16 W/(mK) or more.

8. The pressure steam treatment apparatus of claim 1, wherein a ratio of a height H to a width W of a rectangular-shaped opening section formed between the opposing top and bottom labyrinth nozzles is 1/2000 to 1/60.

9. The pressure steam treatment apparatus of claim 4, wherein one or more heat conductive members are arranged at a right angle to the external wall member and also at a right angle to an opening section and/or parallel to the opening section.

10. The pressure steam treatment apparatus of claim 9, wherein two or more of the heat conductive members are arranged at intervals of 100 mm to 500 mm.

11. The pressure steam treatment apparatus of claim 4, wherein one or more of the heat conductive members are arranged at a right angle to the external wall member and also, diagonally along an opening section.

12. The pressure steam treatment apparatus of claim 4, wherein one or more of the heat conductive members are arranged at a right angle to the external wall member and also at a right angle to an opening section and diagonally along the opening section respectively.

13. The pressure steam treatment apparatus of claim 2, further comprising a heating device that heats the external wall member.

14. A pressure steam treatment apparatus comprising a pressure steam treatment chamber and a labyrinth sealing chamber, wherein:

the labyrinth sealing chamber is arranged on a fiber bundle inlet and a fiber bundle outlet of the steam treatment apparatus, a running path of a fiber bundle is in a horizontal direction; and the apparatus includes an external wall member on an upper surface and a lower surface of the pressure steam treatment apparatus excluding a steam inlet, having a plate member extending along a top board of the pressure steam treatment apparatus on an inner surface of an external wall member of an upper surface, and having a plate member extending along a bottom board of the pressure steam treatment apparatus on an inner surface of an external wall member of a bottom surface; and the apparatus comprises a heating device that heats the external wall member.

15. The pressure steam treatment apparatus of claim 13, further comprising a device that detects the temperature of the external wall member heated by the heating device and a control device that controls the heating temperature of the heating device based on the detection of the temperature control device.

16. A method for producing an acryl fiber bundle, the method comprising performing a drawing treatment of acryl fiber bundles by employing the pressure steam treatment apparatus of claim 1.

17. The pressure steam treatment apparatus of claim 5, wherein the heat conductive member has a heat conductivity of 16 W/(mK) or more.

18. The pressure steam treatment apparatus of claim 5, wherein a ratio of a height H to a width W of a rectangular-shaped opening section formed between the opposing top and bottom labyrinth nozzles is 1/2000 to 1/60.

19. The pressure steam treatment apparatus of claim 5, wherein one or more heat conductive members are arranged at a right angle to the external wall member and also at a right angle to an opening section and/or parallel to the opening section.

20. The pressure steam treatment apparatus of claim 19, wherein two or more of the heat conductive members are arranged at intervals of 100 mm to 500 mm.

21. The pressure steam treatment apparatus of claim 5, wherein one or more of the heat conductive members are arranged at a right angle to the external wall member and also, diagonally along an opening section.

22. The pressure steam treatment apparatus of claim 5, wherein one or more of the heat conductive members are arranged at a right angle to the external wall member and also at a right angle to an opening section and diagonally along the opening section respectively.

23. The pressure steam treatment apparatus of claim 5, further comprising a heating device that heats the external wall member.

24. The pressure steam treatment apparatus of claim 23, further comprising a device that detects the temperature of the external wall member heated by the heating device and a control device that controls the heating temperature of the heating device based on the detection of the temperature control device.

25. The pressure steam treatment apparatus of claim 14, further comprising a device that detects the temperature of the external wall member heated by the heating device and a control device that controls the heating temperature of the heating device based on the detection of the temperature control device.

26. A method for producing an acryl fiber bundle, the method comprising performing a drawing treatment of acryl fiber bundles by employing the pressure steam treatment apparatus of claim 5.

27. A method for producing an acryl fiber bundle, the method comprising performing a drawing treatment of acryl fiber bundles by employing the pressure steam treatment apparatus of claim 14.

* * * * *